US010030200B2

(12) United States Patent
Schlosberg et al.

(10) Patent No.: US 10,030,200 B2
(45) **Date of Patent: *Jul. 24, 2018**

(54) HYDROPROCESSING OIL SANDS-DERIVED, BITUMEN COMPOSITIONS

(71) Applicant: Epic Oil Extractors, LLC, Ponchatoula, LA (US)

(72) Inventors: Richard H. Schlosberg, Highland Park, IL (US); Edward L. Diefenthal, Metairie, LA (US); Richard D. Jordan, Vienna, VA (US)

(73) Assignee: EPIC OIL EXTRACTIONS, LLC, Ponchatoula, LA (US)

( * ) Notice: Subject to any disclaimer, the term of this patent is extended or adjusted under 35 U.S.C. 154(b) by 50 days.

This patent is subject to a terminal disclaimer.

(21) Appl. No.: 15/218,258

(22) Filed: Jul. 25, 2016

(65) Prior Publication Data

US 2016/0333272 A1 Nov. 17, 2016

Related U.S. Application Data

(63) Continuation of application No. 14/318,169, filed on Jun. 27, 2014, now Pat. No. 9,422,482, which is a continuation-in-part of application No. 14/135,396, filed on Dec. 19, 2013, now Pat. No. 9,447,330.

(51) Int. Cl.

| | |
|---|---|
| ***C10G 1/00*** | (2006.01) |
| ***C10G 1/04*** | (2006.01) |
| ***C10G 45/08*** | (2006.01) |
| ***C10G 45/50*** | (2006.01) |
| ***C10G 45/60*** | (2006.01) |
| ***C10G 47/00*** | (2006.01) |
| ***C10G 47/02*** | (2006.01) |
| ***C10G 47/04*** | (2006.01) |

(52) U.S. Cl.

CPC ..... *C10G 1/002* (2013.01); *C10G 1/04* (2013.01); *C10G 1/042* (2013.01); *C10G 1/045* (2013.01); *C10G 45/08* (2013.01); *C10G 45/50* (2013.01); *C10G 45/60* (2013.01); *C10G 47/00* (2013.01); *C10G 47/02* (2013.01); *C10G 47/04* (2013.01); *C10G 2300/1033* (2013.01); *C10G 2300/202* (2013.01); *C10G 2400/02* (2013.01); *C10G 2400/04* (2013.01); *C10G 2400/08* (2013.01)

(58) Field of Classification Search

CPC ..... C10G 1/04; C10G 1/042; C10G 1/045; C10G 45/08; C10G 45/50; C10G 45/60; C10G 47/00; C10G 47/02; C10G 47/04

See application file for complete search history.

(56) References Cited

U.S. PATENT DOCUMENTS

| | | | | |
|---|---|---|---|---|
| 4,401,551 | A * | 8/1983 | Mitchell | C10G 1/04 208/390 |
| 9,422,482 | B2 * | 8/2016 | Schlosberg | C10G 1/04 |
| 2013/0056395 | A1 * | 3/2013 | Pierre, Jr. | C10G 1/002 208/390 |
| 2015/0175892 | A1 * | 6/2015 | Schlosberg | C10G 1/042 208/390 |
| 2015/0175893 | A1 * | 6/2015 | Schlosberg | C10G 1/04 208/390 |

* cited by examiner

*Primary Examiner* — Brian A McCaig
(74) *Attorney, Agent, or Firm* — William H. Honaker; Dickinson Wright PLLC

(57) ABSTRACT

Disclosed are processes for producing deasphalted bitumen and heavy bitumen compositions from oil sands and processes for upgrading the bitumen compositions. The processes for producing the deasphalted bitumen and heavy bitumen compositions involve a Phase I and/or Phase II extraction solvent. According to the Phase I process, a high quality oil sands-derived, deasphalted bitumen can be produced using a Phase I type solvent. According to the Phase II process, a substantial amount of the heavy bitumen on the oil sand can be extracted using a Phase II type solvent, while producing a relatively a tailings by-product that is non-harmful to the environment. The heavy bitumen from the Phase II type extraction process can be hydroprocessed for ready conversion into relatively high volumes of high quality transportation fuels.

12 Claims, No Drawings

HYDROPROCESSING OIL SANDS-DERIVED, BITUMEN COMPOSITIONS

CROSS-REFERENCE TO RELATED APPLICATIONS

This U.S. Continuation Patent Application claims the benefit of U.S. Continuation-in-Part application Ser. No. 14/318,169, filed Jun. 27, 2014 which claims the benefit of U.S. Utility patent application Ser. No. 14/135,396, filed Dec. 19, 2013, which is incorporated herein by reference.

FIELD OF THE INVENTION

This invention relates to a method for producing and hydroprocessing bitumen compositions. In particular, this invention relates to selective extraction of deasphalted bitumen and heavy bitumen compositions from oil sand, using hydrocarbon solvents different from one another, and hydroprocessing the bitumen compositions.

BACKGROUND OF THE INVENTION

The term oil sands generally refers to a mixture of sand, clay and other minerals, water, and bitumen. Oil sands bitumen is very dense and highly viscous (i.e., resistant to flow). At room temperature, oil sands bitumen has the consistency of cold molasses, which makes it difficult to transport.

Resource estimates indicate that oil sands deposits are located throughout the world in varying amounts. By far, the two largest estimated deposits of oil sands are in Canada, particularly the Province of Alberta, and in Venezuela's Orinoco Oil Belt. It has been estimated that Canada has as much as 1.7 trillion barrels of "discovered" oil sands bitumen.

Perhaps a more useful estimate of oil resources is "proven reserves." According to the Energy Information Administration (EIA), proven energy reserves are "estimated quantities of energy sources that analysis of geologic and engineering data demonstrates with reasonable certainty are recoverable under existing economic and operating conditions." See EIA Glossary at http://www.eia.gov/. The Government of Alberta estimates that its proven oil sands reserves are approximately 170 billion barrels, which accounts for 97% of Canada's total proven oil reserves, 7%-10% of the total estimated resource in Canada's geologic basin. See, Oil Sands and the Keystone XL Pipeline: Background and Selected Environmental Issues, Congressional Research Report for Congress, Jonathan L. Ramseur, Coordinator, Feb. 21, 2013.

Estimates of U.S. oil sands deposits vary. According to a "measured-in-place" estimate from the U.S. Geological Survey (USGS), deposits of oil sands in the United States may contain approximately 36 billion barrels. The estimated resource of U.S. oil sands is located in several states in varying amounts: Alaska (41%), Utah (33%), Texas (11%), Alabama (5%), California (5%), and Kentucky (5%).

The deposits are not uniform. For instance, some deposits (estimated at less than 15%) in Utah may be amenable to surface mining techniques. In contrast, the Alaska deposits are buried below several thousand feet of permafrost.

Bitumen (i.e., natural bitumen from oil sands) differs fundamentally from other petroleum oils such as heavy oil, medium oil, and conventional (light) oil. Differences in petroleum oils occur over time, as lighter fractions of the petroleum oils can be lost through natural processes. The result is that petroleum oils become heavy, with a change in chemical composition. In general, as conventional light oil degrades from medium oil to heavy oil to bitumen through natural processes, increases may be seen in density (shown as reductions in API gravity), coke, asphalt, asphaltenes, asphaltenes+resins, residuum yield (percent volume), pour point, dynamic viscosity, and the content of copper, iron, nickel, vanadium among the metals and in nitrogen and sulfur among the non-metals. For example, a heavy oil may exhibit an API gravity of 15-17 degrees, an asphaltene content of 11-13 wt %, and a Conradson Carbon content of 7-9 wt %; whereas a bitumen oil may exhibit an API gravity of 5-7 degrees, an asphaltene content of 25-27 wt %, and a Conradson Carbon content of 12-14 wt %.

Currently about 1.5 million barrels of bitumen oil per day are extracted from Canadian oil sands. A substantial portion of the extracted Canadian bitumen is transported to the United States, where it is upgraded into fuel products.

The majority of the bitumen oil that is upgraded into fuel products is produced through a combination of strip mining and a water-based extraction process. Large quantities of water (2-4 barrels per barrel of oil) are required to obtain a single barrel of oil from the oil sands.

Oil sands companies are currently held to a zero-discharge policy by the Alberta Environmental Protection and Enhancement Act (1993). Thus, all oil sands process water produced must be held on site. This requirement has resulted in over a billion cubic meters of tailings water held in containment systems. Those that produce the tailings water have been held responsible for reclaiming the water and finding a way to release the reclaimed water back into the local environment.

Despite extensive programs that have led to significant improvements including up to 90+% use of recycled water, the tailings ponds and buildup of contaminants in the recycled water and in tailings ponds represent what is considered to be a fundamentally non-sustainable process.

Waterless approaches using hydrocarbon solvent extraction technology have been examined. These approaches offer a pathway to obtaining oil from oil sands that could be potentially low energy, water free, and environmentally superior to the current water-based technology.

U.S. Pat. No. 3,475,318 to Gable et al. is directed to a method of selectively removing oil from oil sands by solvent extraction with subsequent solvent recovery. The extraction solvent consists of a saturated hydrocarbon of from 5 to 9 carbon atoms per molecule. Volatile saturated solvents such as heptane, hexane and non-aromatic gasoline are used to selectively remove saturated and aromatic components of the bitumen from the oil sand, while leaving the asphaltenes on the sand. In order to remove the asphaltenes for process fuel, an aromatic such as benzene or toluene is added to the solvent at a concentration of from 2 to 20 weight percent.

U.S. Pat. No. 4,347,118 to Funk et al. is directed to a solvent extraction process for tar sands, which uses a low boiling solvent having a normal boiling point of from 20° C. to 70° C. to extract the bitumen from the tar sands. The solvent is mixed with tar sands in a dissolution zone at a solvent:bitumen weight ratio of from about 0.5:1 to 2:1. This mixture is passed to a separation zone containing a classifier and countercurrent extraction column, which are used to separate bitumen and inorganic fines from extracted sand. The extracted sand is introduced into a first fluid-bed drying zone fluidized by heated solvent vapors, to remove unbound solvent from extracted sand and lower the water content of the sand to less than about 2 wt. %. The treated sand is then passed into a second fluid-bed drying zone fluidized by a heated inert gas to remove bound solvent. Recovered solvent is recycled to the dissolution zone.

U.S. Pat. No. 7,985,333 to Duyvesteyn is directed to a method for obtaining bitumen from tar sands. The method includes using multiple solvent extraction or leaching steps to separate the bitumen from the tar sands. A light aromatic solvent such as toluene, xylene, kerosene, diesel (including biodiesel), gas oil, light distillate, commercially available aromatic solvents such as Solvesso 100, 150, and 200, naphtha, benzene and aromatic alcohols can be used as a first solvent. A second hydrocarbon solvent, which includes aliphatic compounds having 3 to 9 carbon atoms and liquefied petroleum gas, can also be used in a second extraction process.

U.S. Patent Pub. No. 2009/0294332 to Ryu discloses an oil extraction process that uses an extraction chamber and a hydrocarbon solvent rather than water to extract the oil from oil sand. The solvent is sprayed or otherwise injected onto the oil-bearing product, to leach oil out of the solid product resulting in a composition comprising a mixture of oil and solvent, which is conveyed to an oil-solvent separation chamber.

U. S. Patent Pub. No. 2010/0130386 to Chakrabarty discloses the use of a solvent for bitumen extraction. The solvent includes (a) a polar component, the polar component being a compound comprising a non-terminal carbonyl group; and (b) a non-polar component, the non-polar component being a substantially aliphatic substantially non-halogenated alkane. The solvent has a Hansen hydrogen bonding parameter of 0.3 to 1.7 and/or a volume ratio of (a):(b) in the range of 10:90 to 50:50.

U. S. Patent Pub. No. 2011/0094961 to Phillips discloses a process for separating a solute from a solute-bearing material. The solute can be bitumen and the solute-bearing material can be oil sand. A substantial amount of the bitumen can be extracted from the oil sand by contacting particles of the oil sand with globules of a hydrocarbon extraction solvent. The hydrocarbon extraction solvent is a $C_1$-$C_5$ hydrocarbon.

U. S. Patent Pub. No. 2012/0261313 to Diefenthal et al. is directed to a process for producing a deasphalted bitumen composition from oil sand that uses a solvent comprised of a hydrocarbon mixture. The solvent is injected into a vessel and the oil sand is supplied to the vessel such that the solvent and oil sand contact one another in the vessel, i.e., contact zone of the vessel. The process is carried out such that not greater than 80 wt % of the bitumen is removed from the supplied oil sand, with the removal being controlled by the Hansen solubility blend parameters of the solvent and the vapor condition of the solvent in the contact zone. The extracted oil and at least a portion of the solvent are removed from the vessel for further processing as may be desired.

U.S. Patent Pub. No. 2013/0220890 to Ploemen et al. is directed to a method for extracting bitumen from an oil sand stream. The oil sand stream is contacted with a liquid comprising a solvent to obtain a solvent-diluted oil sand slurry. The solvent-diluted oil sand slurry is separated to obtain a solids-depleted stream and a solids-enriched stream. The solvent-to-bitumen weight ratio (S/B) of the solids-enriched stream is increased to produce a solids-enriched stream having an increased S/B weight ratio and a liquid stream. The solids-enriched stream having an increased S/B weight ratio is filtered to obtain the bitumen-depleted sand. The solvent can include aromatic hydrocarbon solvents and saturated or unsaturated aliphatic hydrocarbon solvents.

There is a continuing need for waterless approaches using hydrocarbon solvent extraction technology to extract the bitumen material from oil sand. There is also a need for converting the extracted bitumen to transportation fuels in a manner that produces greater quantities of the fuels, reduces overall hydrogen consumption, and reduces overall negative environmental impact compared to current processes.

SUMMARY OF THE INVENTION

This invention provides a waterless approach using hydrocarbon solvent extraction technology to selectively extract different fractions of the bitumen from oil sands. The bitumen fractions can be selectively extracted from the oil sands in the form of a high quality, deasphalted bitumen fraction and a heavy bitumen fraction. The high quality deasphalted bitumen can be easily converted to high grade transportation fuels compared to typical bitumen extracted from oil sands, and the extraction process produces relatively dry tailings. Although the heavy bitumen is higher in asphaltene content than the deasphalted bitumen, it can nevertheless be upgraded for ultimate conversion to transportation fuels by various hydroprocessing techniques. The upgrading can be carried out with relatively little petroleum by-product formation, and with an overall reduction in hydrogen consumption and carbon footprint relative to commercial methods being practiced today.

According to one aspect of the invention, there is provided a process for hydroprocessing a heavy bitumen composition derived from total oil sands bitumen. The heavy bitumen composition that is used as a feedstock for the hydroprocessing process can be a bitumen fraction of the total oil sands bitumen that has an asphaltene concentration by weight, measured according to ASTM D6560, greater than that of the total oil sands bitumen.

The heavy bitumen composition can be hydroprocessed by contacting the heavy bitumen composition with a hydroprocessing catalyst in the presence of hydrogen. For example, the hydroprocessing catalyst can comprise at least one Group 6 metal and at least one Group 8-10 metal.

The heavy bitumen fraction can have an asphaltene content of greater than 10 wt %, based on total weight of the heavy bitumen fraction. The asphaltene content can be measured according to ASTM D6560.

According to one aspect of the invention, the heavy bitumen can be provided by contacting oil sands with a hydrocarbon solvent comprised of from 95 wt % to 5 wt % of $C_3$-$C_6$ paraffins. For example, the hydrocarbon solvent can have a Hansen hydrogen bonding blend parameter of at least 0.2 and a Hansen polarity blend parameter of at least 0.2.

The heavy bitumen composition can be provided by treating oil sands with a hydrocarbon solvent to remove a fraction of the total bitumen from the oil sands as the heavy bitumen composition. As one example, the hydrocarbon solvent can be comprised of an admixture of: 1) a light solvent component comprised of at least one $C_3$-$C_6$ paraffin, or at least one halogen-substituted $C_1$-$C_6$ paraffin, or a combination thereof, and 2) an oil sands-derived, deasphalted bitumen having an asphaltene content of not greater than 10 wt %, measured according to ASTM D6560.

As an example, the hydroprocessing catalyst can be comprised of at least one Group 6 metal selected from the group consisting of Mo and W and at least one Group 8-10 metal selected from the group consisting of Co and Ni. Alternatively or additionally, the hydroprocessing catalyst can have a pore diameter of from 30 Å to 1000 Å.

The hydrocarbon solvent can be described according to Hansen Solubility Parameters. For example, the hydrocarbon solvent can have a Hansen hydrogen bonding blend parameter of at least 0.2. Alternatively or additionally, the hydrocarbon solvent can have a Hansen polarity blend parameter of at least 0.2. Alternatively or additionally, the hydrocarbon solvent can have a Hansen dispersion blend parameter of at least 14.

According to an aspect of the invention, the hydrocarbon solvent can be comprised of from 95 wt % to 5 wt % of at least one of $C_3$-$C_6$ paraffins and from 5 wt % to 95 wt % of the oil sands-derived, deasphalted bitumen. For example, the hydrocarbon solvent can be comprised of from 95 wt % to 5 wt % of at least one of propane, butane, pentane and hexane, and from 5 wt % to 95 wt % of the oil sands-derived, deasphalted bitumen. As one particular example, the hydrocarbon solvent can be comprised of from 95 wt % to 5 wt % of propane and from 5 wt % to 95 wt % of the oil sands-derived, deasphalted bitumen. As another particular example, the hydrocarbon solvent can be comprised of from 95 wt % to 5 wt % of pentane and from 5 wt % to 95 wt % of the oil sands-derived, deasphalted bitumen.

DETAILED DESCRIPTION OF THE INVENTION

Processing of Oil Sand and Upgrading of Produced Materials

This invention provides processes for producing deasphalted bitumen and heavy bitumen compositions. The processes for producing the deasphalted bitumen and heavy bitumen compositions are much more environmentally friendly than known processes for producing bitumen compositions from oil sand. Upgrading (e.g., hydroprocessing) the deasphalted bitumen and heavy bitumen compositions to produce high quality transportation fuels can be carried out using substantially less hydrogen, and with reduced carbon footprint, compared to current processes.

The processes for producing the oil sands-derived, deasphalted bitumen and heavy bitumen compositions involve a Phase I and/or Phase II extraction process using hydrocarbon solvents especially suited for producing the respective compositions. The solvents used in Phase I and/or Phase II extraction are different from one another. Preferred characteristics for distinguishing the respective solvents are based on Hansen solubility parameters. The Phase I solvent enables the selective extraction of a high quality, deasphalted bitumen from the oil sands, while the Phase II solvent enables a significant portion of the remaining heavy bitumen to be extracted from the oil sands. The Phase I and Phase II extraction processes can be carried out independently or in conjunction with one another. For example, the Phase I and II processes can be carried out in the form of batch, semi-continuous or continuous series processing.

The Phase II type of process produces a heavy bitumen, which can be upgraded into higher grade transportation fuels through hydroprocessing. Hydroprocessing the heavy bitumen has an advantage of producing less undesirable by-product than is produced in the bitumen removal and upgrading processes being used today. The result is a reduced overall hydrocarbon footprint relative to the water-based extraction and upgrading processes being carried out in Canada today.

Oil Sand

Deasphalted bitumen and heavy bitumen compositions can be extracted from any oil sand according to this invention. The oil sand can also be referred to as oil sands, tar sand, tar sands, bitumen sand or bitumen sands. Additionally, the oil sand can be characterized as being comprised of a porous mineral structure, which contains an oil component. The entire hydrocarbon portion of the oil sand can be referred to as bitumen, alternatively total oil sands bitumen. The processes of this invention are effective on high-grade oil sands ore, which can be considered to contain more than 10 wt % bitumen, as well as mid-grade ore, which can contain about 8-10 wt % bitumen, and low-grade ore, which can contain less than about 8 wt % bitumen, with the wt % bitumen being based on total weight of the oil sands ore including bitumen.

One example of an oil sand from which a deasphalted bitumen composition, as well as a heavy bitumen composition relatively high in asphaltenes content, can be produced according to this invention can be referred to as water wet oil sand, such as that generally found in the Athabasca deposit of Canada. Such oil sand can be comprised of mineral particles surrounded by an envelope of water, which may be referred to as connate water. The raw bitumen material of such water wet oil sand may not be in direct physical contact with the mineral particles, but rather formed as a relatively thin film that surrounds a water envelope around the mineral particles.

Another example of oil sand from which a deasphalted bitumen composition, as well as a heavy bitumen composition relatively high in asphaltenes content, can be produced according to this invention can be referred to as oil wet oil sand, such as that generally found in Utah. Such oil sand may also include water. However, these oil sand materials may not include a water envelope barrier between the raw bitumen material and the mineral particles. Rather, the oil wet oil sand can comprise bitumen in direct physical contact with the mineral component of the oil sand.

In one aspect of the invention, a feed stream of oil sand is supplied to a contact zone, with the oil sand being comprised of at least 2 wt % of bitumen, based on total weight of the supplied oil sand. Preferably, the oil sand feed is comprised of at least 4 wt % of bitumen, more preferably at least 6 wt % of bitumen, still more preferably at least 8 wt % of bitumen, based on total weight of the oil sand feed. The bitumen composition on the oil sand feed refers to total hydrocarbon content of the oil sand feed, which can be determined according to the standard Dean Stark method.

Oil sand can have a tendency to clump due to some stickiness characteristics of the oil component of the oil sand. The oil sand that is fed to the contact zone should not be stuck together such that fluidization of the oil sand in the contact zone or extraction of the oil component in the contact zone is significantly impeded. In one embodiment, the oil sand that is provided or fed to the contact zone has an average particle size of not greater than 20,000 microns. Alternatively, the oil sand that is provided or fed to the contact zone has an average particle size of not greater than 10,000 microns, or not greater than 5,000 microns, or not greater than 2,500 microns.

As a practical matter, the particle size of the oil sand feed material should not be extremely small. For example, it is preferred to have an average particle size of at least 100 microns.

Selective Extraction of High Quality Deasphalted Bitumen

High quality oil sands-derived, deasphalted bitumen can be extracted from oil sand using a Phase I type solvent (i.e., a Phase I type process). The Phase I solvent can be comprised of a hydrocarbon mixture, and the mixture can be comprised of at least two, or at least three or at least four different hydrocarbons.

The term "hydrocarbon" refers to any chemical compound that is comprised of at least one hydrogen and at least one carbon atom covalently bonded to one another (C—H). Preferably, the Phase I solvent is comprised of at least 40 wt % hydrocarbon. Alternatively, the Phase I solvent is comprised of at least 60 wt % hydrocarbon, or at least 80 wt % hydrocarbon, or at least 90 wt % hydrocarbon.

The Phase I solvent can further comprise hydrogen or inert components. The inert components are considered compounds that are substantially unreactive with the hydrocarbon component or the oil components of the oil sand at the conditions at which the solvent is used in any of the steps of the process of the invention. Examples of such inert components include, but are not limited to, nitrogen and water, including water in the form of steam. Hydrogen, however, may or may not be reactive with the hydrocarbon or oil components of the oil sand, depending upon the conditions at which the solvent is used in any of the steps of the process of the invention.

Treatment of the oil sand with the Phase I solvent is carried out as a vapor state treatment, particularly as a mixed vapor and liquid state treatment. For example, at least a portion of the Phase I solvent in the vessel, which serves as a contact zone for the solvent and oil sand, is in the vapor state and the remainder in the liquid state. In one embodiment, at least 20 wt % of the Phase I solvent in the contact zone is in the vapor state and the remainder in the liquid state. Alternatively, at least 40 wt %, or at least 60 wt %, or at least 80 wt % of the Phase I solvent in the contact zone is in the vapor state, with the remainder in the liquid state.

The hydrocarbon of the Phase I solvent can be comprised of a mix of hydrocarbon compounds. The hydrocarbon compounds can range from 1 to 20 carbon atoms. In an alternative embodiment, the hydrocarbon of the solvent is comprised of a mixture of hydrocarbon compounds having from 1 to 15, alternatively from 1 to 10, carbon atoms. Examples of such hydrocarbons include aliphatic hydrocarbons, olefinic hydrocarbons and aromatic hydrocarbons. Particular aliphatic hydrocarbons include $C_3$-$C_6$ paraffins, as well as halogen-substituted $C_1$-$C_6$ or $C_3$-$C_6$ paraffins. Examples of particular $C_3$-$C_6$ paraffins include, but are not limited to propane, butane, pentane and hexane, in which the terms "butane," "pentane" and "hexane" refer to at least one linear or branched butane, pentane or hexane, respectively. For example, the hydrocarbon solvent can be comprised of a majority, or at least 60 wt %, or at least 80 wt %, or at least 90 wt %, of at least one of propane, butane, pentane, and hexane. Examples of $C_1$-$C_6$ halogen-substituted paraffins include, but are not limited to chlorine and fluorine substituted paraffins, such as $C_1$-$C_6$ chlorine or fluorine substituted or $C_1$-$C_3$ chlorine or fluorine substituted paraffins.

The hydrocarbon component of the Phase I solvent can be selected according to the amount of bitumen component that is desired to be extracted from the oil sand feed, and according to the desired asphaltene content of the extracted bitumen component. The degree of extraction can be determined according to the amount of bitumen that remains with the oil sand following treatment or extraction. This can be determined according to the Dean Stark process.

The asphaltene content of the deasphalted bitumen extracted from the oil sands using a Phase I type solvent can be determined according to ASTM D6560-00(2005) Standard Test Method for Determination of Asphaltenes (Heptane Insolubles) in Crude Petroleum and Petroleum Products.

In general, the Phase I solvent extracts from the oil sands a bitumen fraction, which is considered a deasphalted bitumen composition in that the deasphalted bitumen is lower in asphaltene content relative to the total bitumen from which the fraction is extracted. Particularly effective hydrocarbons for use as the solvent according to the Phase I extraction can be classified according to Hansen solubility parameters, which is a three component set of parameters that takes into account a compound's dispersion force, polarity, and hydrogen bonding force. The Hansen solubility parameters are, therefore, each defined as a dispersion parameter (D), polarity parameter (P), and hydrogen bonding parameter (H). These parameters are listed for numerous compounds and can be found in *Hansen Solubility Parameters in Practice*—Complete with software, data, and examples, Steven Abbott, Charles M. Hansen and Hiroshi Yamamoto, 3rd ed., 2010, ISBN: 9780955122026, the contents of which are incorporated herein by reference. Examples of the Hansen solubility parameters are shown in Tables 1-12.

TABLE 1

| | Hansen Parameter | | |
|---|---|---|---|
| Alkanes | D | P | H |
| Propane | 13.9 | 0 | 0 |
| n-Butane | 14.1 | 0.0 | 0.0 |
| n-Pentane | 14.5 | 0.0 | 0.0 |
| n-Hexane | 14.9 | 0.0 | 0.0 |
| n-Heptane | 15.3 | 0.0 | 0.0 |
| n-Octane | 15.5 | 0.0 | 0.0 |
| Isooctane | 14.3 | 0.0 | 0.0 |
| n-Dodecane | 16.0 | 0.0 | 0.0 |
| Cyclohexane | 16.8 | 0.0 | 0.2 |
| Methylcyclohexane | 16.0 | 0.0 | 0.0 |

TABLE 2

| | Hansen Parameter | | |
|---|---|---|---|
| Aromatics | D | P | H |
| Benzene | 18.4 | 0.0 | 2.0 |
| Toluene | 18.0 | 1.4 | 2.0 |
| Naphthalene | 19.2 | 2.0 | 5.9 |
| Styrene | 18.6 | 1.0 | 4.1 |
| o-Xylene | 17.8 | 1.0 | 3.1 |
| Ethyl benzene | 17.8 | 0.6 | 1.4 |
| p-Diethyl benzene | 18.0 | 0.0 | 0.6 |

TABLE 3

| | Hansen Parameter | | |
|---|---|---|---|
| Halohydrocarbons | D | P | H |
| Chloromethane | 15.3 | 6.1 | 3.9 |
| Methylene chloride | 18.2 | 6.3 | 6.1 |
| 1,1 Dichloroethylene | 17.0 | 6.8 | 4.5 |
| Ethylene dichloride | 19.0 | 7.4 | 4.1 |
| Chloroform | 17.8 | 3.1 | 5.7 |

TABLE 3-continued

| Halohydrocarbons | Hansen Parameter D | P | H |
|---|---|---|---|
| 1,1 Dichloroethane | 16.6 | 8.2 | 0.4 |
| Trichloroethylene | 18.0 | 3.1 | 5.3 |
| Carbon tetrachloride | 17.8 | 0.0 | 0.6 |
| Chlorobenzene | 19.0 | 4.3 | 2.0 |
| o-Dichlorobenzene | 19.2 | 6.3 | 3.3 |
| 1,1,2 Trichlorotrifluoroethane | 14.7 | 1.6 | 0.0 |

TABLE 4

| Ethers | Hansen Parameter D | P | H |
|---|---|---|---|
| Tetrahydrofuran | 16.8 | 5.7 | 8.0 |
| 1,4 Dioxane | 19.0 | 1.8 | 7.4 |
| Diethyl ether | 14.5 | 2.9 | 5.1 |
| Dibenzyl ether | 17.4 | 3.7 | 7.4 |

TABLE 5

| Ketones | Hansen Parameter D | P | H |
|---|---|---|---|
| Acetone | 15.5 | 10.4 | 7.0 |
| Methyl ethyl ketone | 16.0 | 9.0 | 5.1 |
| Cyclohexanone | 17.8 | 6.3 | 5.1 |
| Diethyl ketone | 15.8 | 7.6 | 4.7 |
| Acetophenone | 19.6 | 8.6 | 3.7 |
| Methyl isobutyl ketone | 15.3 | 6.1 | 4.1 |
| Methyl isoamyl ketone | 16.0 | 5.7 | 4.1 |
| Isophorone | 16.6 | 8.2 | 7.4 |
| Di-(isobutyl) ketone | 16.0 | 3.7 | 4.1 |

TABLE 6

| Esters | Hansen Parameter D | P | H |
|---|---|---|---|
| Ethylene carbonate | 19.4 | 21.7 | 5.1 |
| Methyl acetate | 15.5 | 7.2 | 7.6 |
| Ethyl formate | 15.5 | 7.2 | 7.6 |
| Propylene 1,2 carbonate | 20.0 | 18.0 | 4.1 |
| Ethyl acetate | 15.8 | 5.3 | 7.2 |
| Diethyl carbonate | 16.6 | 3.1 | 6.1 |
| Diethyl sulfate | 15.8 | 14.7 | 7.2 |
| n-Butyl acetate | 15.8 | 3.7 | 6.3 |
| Isobutyl acetate | 15.1 | 3.7 | 6.3 |
| 2-Ethoxyethyl acetate | 16.0 | 4.7 | 10.6 |
| Isoamyl acetate | 15.3 | 3.1 | 7.0 |
| Isobutyl isobutyrate | 15.1 | 2.9 | 5.9 |

TABLE 7

| Nitrogen Compounds | Hansen Parameter D | P | H |
|---|---|---|---|
| Nitromethane | 15.8 | 18.8 | 5.1 |
| Nitroethane | 16.0 | 15.5 | 4.5 |
| 2-Nitropropane | 16.2 | 12.1 | 4.1 |
| Nitrobenzene | 20.0 | 8.6 | 4.1 |
| Ethanolamine | 17.2 | 15.6 | 21.3 |
| Ethylene diamine | 16.6 | 8.8 | 17.0 |
| Pyridine | 19.0 | 8.8 | 5.9 |
| Morpholine | 18.8 | 4.9 | 9.2 |
| Aniline | 19.4 | 5.1 | 10 |

TABLE 7-continued

| Nitrogen Compounds | Hansen Parameter D | P | H |
|---|---|---|---|
| N-Methyl-2-pyrrolidone | 18.0 | 12.3 | 7.2 |
| Cyclohexylamine | 17.4 | 3.1 | 6.6 |
| Quinoline | 19.4 | 7.0 | 7.6 |
| Formamide | 17.2 | 26.2 | 19.0 |
| N,N-Dimethylformamide | 17.4 | 13.7 | 11.3 |

TABLE 8

| Sulfur Compounds | Hansen Parameter D | P | H |
|---|---|---|---|
| Carbon disulfide | 20.5 | 0.0 | 0.6 |
| Dimethylsulfoxide | 18.4 | 16.4 | 10.2 |
| Ethanethiol | 15.8 | 6.6 | 7.2 |

TABLE 9

| Alcohols | Hansen Parameter D | P | H |
|---|---|---|---|
| Methanol | 15.1 | 12.3 | 22.3 |
| Ethanol | 15.8 | 8.8 | 19.4 |
| Allyl alcohol | 16.2 | 10.8 | 16.8 |
| 1-Propanol | 16.0 | 6.8 | 17.4 |
| 2-Propanol | 15.8 | 6.1 | 16.4 |
| 1-Butanol | 16.0 | 5.7 | 15.8 |
| 2-Butanol | 15.8 | 5.7 | 14.5 |
| Isobutanol | 15.1 | 5.7 | 16.0 |
| Benzyl alcohol | 18.4 | 6.3 | 13.7 |
| Cyclohexanol | 17.4 | 4.1 | 13.5 |
| Diacetone alcohol | 15.8 | 8.2 | 10.8 |
| Ethylene glycol monoethyl ether | 16.2 | 9.2 | 14.3 |
| Diethylene glycol monomethyl ether | 16.2 | 7.8 | 12.7 |
| Diethylene glycol monoethyl ether | 16.2 | 9.2 | 12.3 |
| Ethylene glycol monobutyl ether | 16.0 | 5.1 | 12.3 |
| Diethylene glycol monobutyl ether | 16.0 | 7.0 | 10.6 |
| 1-Decanol | 17.6 | 2.7 | 10.0 |

TABLE 10

| Acids | Hansen Parameter D | P | H |
|---|---|---|---|
| Formic acid | 14.3 | 11.9 | 16.6 |
| Acetic acid | 14.5 | 8.0 | 13.5 |
| Benzoic acid | 18.2 | 7.0 | 9.8 |
| Oleic acid | 14.3 | 3.1 | 14.3 |
| Stearic acid | 16.4 | 3.3 | 5.5 |

TABLE 11

| Phenols | Hansen Parameter D | P | H |
|---|---|---|---|
| Phenol | 18.0 | 5.9 | 14.9 |
| Resorcinol | 18.0 | 8.4 | 21.1 |
| m-Cresol | 18.0 | 5.1 | 12.9 |
| Methyl salicylate | 16.0 | 8.0 | 12.3 |

TABLE 12

| Polyhydric alcohols | Hansen Parameter D | P | H |
|---|---|---|---|
| Ethylene glycol | 17.0 | 11.0 | 26.0 |
| Glycerol | 17.4 | 12.1 | 29.3 |
| Propylene glycol | 16.8 | 9.4 | 23.3 |
| Diethylene glycol | 16.2 | 14.7 | 20.5 |
| Triethylene glycol | 16.0 | 12.5 | 18.6 |
| Dipropylene glycol | 16.0 | 20.3 | 18.4 |

According to the Hansen Solubility Parameter System, a mathematical mixing rule can be applied in order to derive or calculate the respective Hansen parameters for a blend of hydrocarbons from knowledge of the respective parameters of each hydrocarbon component and the volume fraction of the hydrocarbon component. Thus according to this mixing rule:

$$D\text{blend}=\Sigma Vi\cdot Di,$$

$$P\text{blend}=\Sigma Vi\cdot Pi,$$

$$H\text{blend}=\Sigma Vi\cdot Hi,$$

where Dblend is the Hansen dispersion parameter of the blend, Di is the Hansen dispersion parameter for component i in the blend; Pblend is the Hansen polarity parameter of the blend, Pi is Hansen polarity parameter for component i in the blend, Hblend is the Hansen hydrogen bonding parameter of the blend, Hi is the Hansen hydrogen bonding parameter for component i in the blend, Vi is the volume fraction for component i in the blend, and summation is over all i components in the blend.

The Hansen parameters of the Phase I solvent, as well as the Phase II solvent described below, can be defined according to the mathematical mixing rule. The Phase I solvent can be essentially pure or it can be comprised of a blend of hydrocarbon compounds, and can optionally include limited amounts of non-hydrocarbons. In cases when non-hydrocarbon compounds are included in the Phase I solvent, as well as the Phase II solvent described below, the Hansen solubility parameters of the non-hydrocarbon compounds should also be taken into account according to the mathematical mixing rule. Thus, reference to Hansen solubility blend parameters of the Phase I and Phase II solvents takes into account the Hansen parameters of all the compounds present. Of course, it may not be practical to account for every compound present in the solvent. In such complex cases, the Hansen solubility blend parameters can be determined according to *Hansen Solubility Parameters in Practice*. See, e.g., Chapter 3, pp. 15-18, and Chapter 8, pp. 43-46, for further description.

The Phase I solvent is selected to limit the amount of asphaltenes that are extracted from oil sand in the Phase I extraction. The more desirable Phase I solvents have Hansen blend parameters that are relatively low. Lower values for the Hansen dispersion blend parameter and/or the Hansen polarity blend parameter are particularly preferred. Especially desirable solvents have low Hansen dispersion blend and Hansen polarity blend parameters.

The Hansen dispersion blend parameter of the Phase I solvent is desirably less than 16. In general, lower dispersion blend parameters are particularly desirable. As an example, the Phase I solvent is comprised of a hydrocarbon mixture, with the Phase I solvent having a Hansen dispersion blend parameter of not greater than 15. Additional examples include Phase I solvents comprised of a hydrocarbon mixture, with the solvent having a Hansen dispersion blend parameter of from 13 to 16 or from 13 to 15.

The Hansen polarity blend parameter of the Phase I solvent is desirably less than 2. In general, lower polarity blend parameters are particularly desirable. It is further desirable to use Phase I solvents that have both low Hansen dispersion blend parameters, as defined above, along with the low Hansen polarity blend parameters. As an example of low polarity blend parameters, the Phase I solvent is comprised of a hydrocarbon mixture, with the Phase I solvent having a Hansen polarity blend parameter of not greater than 1, alternatively not greater than 0.5, or not greater than 0.1. Additional examples include Phase I solvents comprised of a hydrocarbon mixture, with the solvent having a Hansen polarity blend parameter of from 0 to 2 or from 0 to 1.5 or from 0 to 1 or from 0 to 0.5 or from 0 to 0.1.

The Hansen hydrogen bonding blend parameter of the Phase I solvent is desirably less than 2. In general, lower hydrogen bonding blend parameters are particularly desirable. It is further desirable to use Phase I solvents that have low Hansen dispersion blend parameters and Hansen polarity blend parameters, as defined above, along with the low Hansen hydrogen bonding blend parameters. As an example of low hydrogen bonding blend parameters, the Phase I solvent is comprised of a hydrocarbon mixture, with the Phase I solvent having a Hansen hydrogen bonding blend parameter of not greater than 1, alternatively not greater than 0.5, or not greater than 0.1, or not greater than 0.05. Additional examples include Phase I solvents comprised of a hydrocarbon mixture, with the Phase I solvent having a Hansen hydrogen bonding blend parameter of from 0 to 1 or from 0 to 0.5 or from 0 to 0.1 or from 0 to 0.05.

The Phase I solvent can be a blend of relatively low boiling point compounds. In a case in which the Phase I solvent is a blend of compounds, the boiling range of Phase I solvent compounds can be determined by batch distillation according to ASTM D86-09e1, Standard Test Method for Distillation of Petroleum Products at Atmospheric Pressure.

In one embodiment, the Phase I solvent has an ASTM D86 10% distillation point of greater than or equal to −45° C. Alternatively, the Phase I solvent has an ASTM D86 10% distillation point of greater than or equal to −40° C., or greater than or equal to −30° C. The Phase I solvent can have an ASTM D86 10% distillation point within the range of from −45° C. to 50° C., alternatively within the range of from −35° C. to 45° C., or from −20° C. to 40° C.

The Phase I solvent can have an ASTM D86 90% distillation point of not greater than 300° C. Alternatively, the Phase I solvent can have an ASTM D86 90% distillation point of not greater than 200° C., or not greater than 100° C., or not greater than 50° C.

The Phase I solvent can have a significant difference between its ASTM D86 90% distillation point and its ASTM D86 10% distillation point. For example, the Phase I solvent can have a difference of at least 5° C. between its ASTM D86 90% distillation point and its ASTM D86 10% distillation point, alternatively a difference of at least 10° C., or at least 15° C. However, the difference between the solvent's Phase I ASTM D86 90% distillation point and ASTM D86 10% distillation point should not be so great such that efficient recovery of solvent from extracted crude is impeded. For example, the Phase I solvent can have a difference of not greater than 60° C. between its ASTM D86 90% distillation point and its ASTM D86 10% distillation point, alternatively a difference of not greater than 40° C., or not greater than 20° C.

Solvents high in aromatic content are not particularly desirable as Phase I solvents. For example, the Phase I solvent can have an aromatic content of not greater than 10 wt %, alternatively not greater than 5 wt %, or not greater than 3 wt %, or not greater than 2 wt %, based on total weight of the solvent injected into the extraction vessel. The aromatic content can be determined according to test method ASTM D6591-06 Standard Test Method for Determination of Aromatic Hydrocarbon Types in Middle Distillates-High Performance Liquid Chromatography Method with Refractive Index Detection.

Solvents high in ketone content are also not particularly desirable as Phase I solvents. For example, the Phase I solvent can have a ketone content of not greater than 10 wt %, alternatively not greater than 5 wt %, or not greater than 2 wt %, based on total weight of the solvent injected into the extraction vessel. The ketone content can be determined according to test method ASTM D4423-10 Standard Test Method for Determination of Carbonyls in $C_4$ Hydrocarbons.

In one embodiment, the Phase I solvent can be comprised of hydrocarbon in which at least 60 wt % of the hydrocarbon is aliphatic hydrocarbon, based on total weight of the solvent. Alternatively, the solvent can be comprised of hydrocarbon in which at least 70 wt %, or at least 80 wt %, or at least 90 wt % of the hydrocarbon is aliphatic hydrocarbon, based on total weight of the solvent. Particular examples of aliphatic hydrocarbons include $C_3$-$C_6$ paraffins, as well as halogen-substituted $C_1$-$C_6$ or $C_3$-$C_6$ paraffins, as previously described.

The Phase I solvent preferably does not include substantial amounts of non-hydrocarbon compounds. Non-hydrocarbon compounds are considered chemical compounds that do not contain any C—H bonds. Examples of non-hydrocarbon compounds include, but are not limited to, hydrogen, nitrogen, water and the noble gases, such as helium, neon and argon. For example, the Phase I solvent preferably includes not greater than 20 wt %, alternatively not greater than 10 wt %, alternatively not greater than 5 wt %, non-hydrocarbon compounds, based on total weight of the solvent injected into the extraction vessel.

Solvent to oil sand feed ratios can vary according to a variety of variables. Such variables include amount of hydrocarbon mix in the Phase I solvent, temperature and pressure of the contact zone, and contact time of hydrocarbon mix and oil sand in the contact zone. Preferably, the Phase I solvent and oil sand is supplied to the contact zone of the extraction vessel at a weight ratio of total hydrocarbon in the solvent to oil sand feed of at least 0.01:1, or at least 0.1:1, or at least 0.5:1 or at least 1:1. Very large total hydrocarbon to oil sand ratios are not required. For example, the Phase I solvent and oil sand can be supplied to the contact zone of the extraction vessel at a weight ratio of total hydrocarbon in the solvent to oil sand feed of not greater than 4:1, or 3:1, or 2:1.

Extraction of oil compounds from the oil sand in the Phase I extraction of deasphalted bitumen from the bitumen is carried out in a contact zone such as in a vessel having a zone in which the Phase I solvent contacts the oil sand. Any type of extraction vessel can be used that is capable of providing contact between the oil sand and the solvent such that a portion of the oil is removed from the oil sand. For example, horizontal or vertical type extractors can be used. The solid can be moved through the extractor by pumping, such as by auger-type movement, or by fluidized type of flow, such as free fall or free flow arrangements. An example of an auger-type system is described in U.S. Pat. No. 7,384,557. An example of fluidized type flow is described in US Patent Pub. No. 2013/0233772.

The Phase I solvent can be injected into the vessel by way of nozzle-type devices. Nozzle manufacturers are capable of supplying any number of nozzle types based on the type of spray pattern desired.

The contacting of oil sand with Phase I solvent in the contact zone of the extraction vessel is at a pressure and temperature in which at least 20 wt % of the hydrocarbon mixture within the contacting zone of the vessel is in vapor phase during contacting, with the remainder being in liquid phase. Preferably, at least 40 wt %, or at least 60 wt % or at least 80 wt % of the hydrocarbon mixture within the contacting zone of the vessel is in vapor phase, with the remainder being in liquid phase. Because distinct liquid and gas phases exist, the hydrocarbon mixture in the reaction zone is not considered a supercritical fluid.

Carrying out the extraction process at the desired vapor and liquid conditions using the desired Phase I solvent is at least one factor for controlling the amount of bitumen and asphaltenes extracted from the oil sand. For example, contacting the oil sand with the Phase I solvent in a vessel's contact zone can produce a deasphalted bitumen composition comprised of not greater than 80 wt %, or of not greater than 70 wt %, or not greater than 60 wt %, or not greater than 50 wt % of the bitumen from the supplied oil sand. The deasphalted bitumen composition also has an asphaltene concentration by weight, as measured according to ASTM D6560, which is less than that of the bitumen originally present on the oil sand (also referred to as total oil sands bitumen). Because the extraction process can be controlled to remove primarily a low asphaltene-containing fraction of the bitumen from the oil sands, the process is generally referred to as selective extraction and the high quality bitumen fraction that is extracted is referred to as deasphalted bitumen.

The Phase I solvent can be comprised of a hydrocarbon mix or blend that has the desired characteristics for extracting or removing the desired quantity of bitumen from the supplied oil sand. This deasphalted bitumen composition that leaves the extraction zone can also include at least a portion of the Phase I solvent. However, a substantial portion of the Phase I solvent can be separated from the deasphalted bitumen composition to produce a deasphalted bitumen composition that can be pipelined, transported by other means such as railcar or truck, or further upgraded to make fuel products. The separated Phase I solvent can then be recycled. Since the Phase I extraction process incorporates a relatively light solvent blend relative to the deasphalted bitumen composition, the Phase I solvent portion can be easily recovered, with little if any external make-up being required.

The oil sands-derived, deasphalted bitumen composition will be reduced in metals and asphaltenes compared to typical processes. Metals content can be determined according to ASTM D5708-11 Standard Test Methods for Determination of Nickel, Vanadium, and Iron in Deasphalted bitumens and Residual Fuels by Inductively Coupled Plasma (ICP) Atomic Emission Spectrometry. For example, the deasphalted bitumen composition can have a nickel plus vanadium content of not greater than 250 wppm, or not greater than 150 wppm, or not greater than 100 wppm, based on total weight of the composition.

The oil sands derived, deasphalted bitumen has a relatively low asphaltene content, which can be defined according to asphaltene concentration by weight (i.e., heptane insolubles measured according to ASTM D6560). The deasphalted bitumen composition extracted according to a Phase I type process, using a Phase I type solvent, has an asphaltene concentration less than that of the bitumen originally present on the oil sand (also referred to as total oil sands bitumen).

The asphaltene content of the deasphalted bitumen extracted according to the Phase I type process can be defined according to an asphaltene index in which the asphaltene index is defined as the asphaltene content of crude (i.e., deasphalted) bitumen separated from the oil sands using the Phase I solvent divided by the asphaltene content of the total bitumen initially present on the oil sand. As an example, the deasphalted bitumen can have an asphaltene index of not greater than 0.5, alternatively not greater than 0.3, or not greater than 0.1.

As another example, the oil sands-derived, deasphalted bitumen composition can have an asphaltenes content of not greater than 10 wt %, alternatively not greater than 7 wt %, or not greater than 5 wt %, or not greater than 3 wt %, or not greater than 1 wt %, or not greater than 0.1 wt %, measured according to ASTM D6560.

The oil sands-derived, deasphalted bitumen composition can also have a reduced Conradson Carbon Residue (CCR), measured according to ASTM D4530. For example, the deasphalted bitumen composition can have a CCR of not greater than 15 wt %, or not greater than 10 wt %, or not greater than 5 wt %, or not greater than 3 wt %.

The Phase I extraction is carried out at temperatures and pressures that allow at least a portion of the solvent to be maintained in the vapor phase in the contact zone, in which it is understood that the temperature and pressure conditions of the solvent are the temperature and pressure conditions below the solvent's critical point. The solvent's critical point represents the highest temperature and pressure at which the solvent can exist as a vapor and liquid in equilibrium. In cases in which the Phase I solvent is a mixture of hydrocarbons, operating conditions are such that at least 80 wt %, or at least 90 wt %, or at least 100 wt % of the total Phase I solvent injected into the contact zone is maintained at below supercritical conditions in the contact zone.

Since at least a portion of the Phase I solvent is in the vapor phase in the contact zone, contact zone temperatures and pressures can be adjusted to provide the desired vapor and liquid phase equilibrium. Temperatures higher than the IUPAC established standard temperature of 0° C. are most practical. For example, the contacting of the oil sand and the solvent in the contact zone of the extraction vessel can be carried out at a temperature of at least 20° C., or at least 35° C., or at least 50° C., or at least 70° C. Upper temperature limits depend primarily upon physical constraints, such as contact vessel materials. In addition, temperatures should be limited to below cracking conditions for the extracted crude. Generally, it is desirable to maintain temperature in the contact vessel at not greater than 500° C., alternatively not greater than 400° C. or not greater than 300° C., or not greater than 100° C., or not greater than 80° C.

Pressure in the contact zone can vary as long as the desired amount of hydrocarbon in the solvent remains in the vapor phase in the contact zone. Pressures higher than the IUPAC established standard temperature of 1 bar are most practical. For example, pressure in the contacting zone can be at least 15 psia (103 kPa), or at least 50 psia (345 kPa), or at least 100 psia (689 kPa), or at least 150 psia (1034 kPa). Extremely high pressures are not preferred to ensure that at least a portion of the solvent remains in the vapor phase. For example, the contacting of the oil sand and the solvent in the contact zone of the extraction vessel can be carried out a pressure of not greater than 600 psia (4137 kPa), alternatively not greater than 500 psia (3447 kPa), or not greater than 400 psia (2758 kPa) or not greater than 300 psia (2068 kPa).

Contact time of the Phase I solvent with the oil sands in the contact zone should be kept relatively short so that selective extraction of a deasphalted bitumen fraction can be carried out. If contact time is too long, there is a potential that at least some of the deasphalted bitumen fraction can act as solvent itself. In such case, the asphaltene content of the extracted bitumen fraction can be undesirably increased as contact time increases. The methods and devices disclosed herein enable the short contact times to be carried out.

The exact time for contact between the Phase I solvent and the oil sands to be carried out can vary depending upon the type of equipment used and the ability to timely filter or separate the extracted liquids from the oil sands. Therefore, contact time can be indirectly determined according to asphaltene content of the extracted bitumen and the percentage of the bitumen extracted from the oil sands. The time should not be too long so that the extracted bitumen has the desired asphaltene concentration, as described herein. The time should also be sufficiently long so that the degree or amount of bitumen that is extracted from the oil sands is within the desired parameters, as also described herein.

The deasphalted bitumen composition that is removed from the contact zone of the extraction vessel in the Phase I extraction can further comprise at least a portion of the Phase I solvent. At least a portion of the Phase I solvent in the oil composition can be relatively easily separated and recycled for reuse as solvent in the Phase I extraction step. This separated solvent is separated so as to match or correspond within 50%, preferably within 30%, or 20%, or 10%, of the Hansen solubility characteristics of any make-up Phase I solvent, i.e., the overall generic chemical components and boiling points as described above for the solvent composition. For example, an extracted crude product containing the extracted deasphalted bitumen and Phase I solvent is sent to a separator and a light fraction is separated from a deasphalted bitumen fraction in which the separated solvent has each of the Hansen solubility characteristics and each of the boiling point ranges within 50% of the above noted amounts, alternatively within 30%, or 20%, or 10%, of the above noted amounts. This separation can be achieved using any appropriate chemical separation process. For example, separation can be achieved using any variety of evaporators, flash drums or distillation equipment or columns. The separated solvent can be recycled to contact oil sand, and optionally mixed with make-up Phase I solvent having the characteristics indicated above.

Following extraction of the desired bitumen fraction from the Phase I extraction process, the extracted composition is separated into fractions comprised of recycle solvent and oil sands-derived, deasphalted bitumen. The oil sands-derived, deasphalted bitumen can be relatively high in quality in that it can have relatively low metals and asphaltenes content as described above. The low metals and asphaltenes content enables the deasphalted bitumen composition to be relatively easily upgraded to liquid fuels compared to typical oil sands-derived bitumen compositions.

The deasphalted bitumen composition will have a relatively high API gravity compared to typical oil sands-derived bitumen compositions. API gravity can be determined according to ASTM D287-92(2006) Standard Test Method for API Gravity of Crude Petroleum and Petroleum Products (Hydrometer Method). The deasphalted bitumen composition can, for example, have an API gravity of at least 8, or at least 10, or at least 12, or at least 14, depending on the exact solvent composition and process conditions.

Extraction of Heavy Bitumen

The oil sand that is provided as feedstock for treatment using a Phase II type solvent can be oil sand that has been mined and not previously solvent-treated (e.g., Phase I extraction using a Phase I solvent). Alternatively, oil sand that is provided as feedstock for treatment using a Phase II type solvent can be oil sand that has been treated to remove a significant portion of low-asphaltene, deasphalted bitumen from the total bitumen on the originally mined oil sand. For example, oil sand feedstock provided for Phase II extraction can be oil sand taken from a mining operation or oil sand product or tailings obtained from the Phase I treatment process steps of this invention. Therefore, the Phase II type treatment can be carried out independent of or in conjunction with (e.g., in series with) the Phase I treatment process.

Oil sand feedstock that has been treated to remove at least a portion of the bitumen from mined oil sand can contain from 10% to 60% of the total weight of the bitumen present on the untreated oil sand. For example, the treated oil sand can contain from 15% to 55%, or 20% to 50%, or 25% to 45% of the total weight of the bitumen present on the untreated oil sand.

The oil sand that is provided as feedstock for treatment according to the Phase II extraction steps of this invention can also be oil sand that is low in overall bitumen content relative to the total weight of the oil sand. For example, the oil sand feedstock that is provided for a Phase II type treatment can be comprised of not greater than 8 wt % total bitumen content, based on total weight of the oil sand feedstock. Alternatively, the oil sand feedstock that is provided for a Phase II type treatment can be comprised of not greater than 6 wt % total bitumen content, or not greater than 4 wt % total bitumen content, based on total weight of the oil sand feedstock. The total bitumen content can be measured according to the Dean-Stark method (ASTM D95-05e1 Standard Test Method for Water in Petroleum Products and Bituminous Materials by Distillation).

In the Phase II type extraction, the oil sand provided as feed stock is contacted with a solvent that is different from the solvent used in the Phase I type extraction, since the solvent used in the Phase II type extraction process will be a solvent that more readily solubilizes asphaltenic compounds present on the provided oil sand relative to the solvent used in the Phase I extraction. The Phase II type solvent can be comprised of a hydrocarbon mixture, and the mixture can be comprised of at least two, or at least three or at least four different hydrocarbons.

The Phase II solvent can further comprise hydrogen or inert components. The inert components are considered compounds that are substantially unreactive with the hydrocarbon component or the oil components of the oil sand at the conditions at which the solvent is used in any of the steps of the process of the invention. Examples of such inert components include, but are not limited to, nitrogen and water, including water in the form of steam. Hydrogen, however, may or may not be reactive with the hydrocarbon or oil components of the oil sand, depending upon the conditions at which the solvent is used in any of the steps of the process of the invention.

Treatment of the oil sand with the Phase II solvent can be carried out under conditions in which at least a portion of the Phase II solvent contacts the oil sand in a contact zone of a contactor in the liquid phase. For example, at least 70 wt % of the Phase II solvent in the contact zone can be in the liquid phase. Alternatively, at least 75 wt %, or at least 80 wt %, or at least 90 wt % of the Phase II solvent in the contact zone can be in the liquid phase.

The Phase II solvent is more highly soluble with asphaltenes than the Phase I solvent used to obtain the high quality deasphalted bitumen. Particularly effective solvents used in the Phase II type extraction of this invention have Hansen solubility parameters higher than that of the solvent used in the Phase I type extraction of this invention. For example, at least one of the Hansen dispersion parameter (D), polarity parameter (P), and hydrogen bonding parameter (H) of the Phase II solvent is higher than that of the Phase I solvent, with none of the Hansen parameters of the Phase II solvent being less than that of the Phase I solvent.

Phase II solvent can be considered solvent that is capable of removing a substantially greater portion of the bitumen from the oil sand than the Phase I solvent that is used to selectively extract a deasphalted bitumen relatively low in asphaltene content from the bitumen on the oil sand. An example of a Phase II type solvent that is capable of removing a substantially greater portion of the high-asphaltene concentration bitumen than a Phase I type solvent is a solvent comprised of an admixture of a Phase I-type hydrocarbon component (light solvent) and an oil sands-derived, deasphalted bitumen component. Particular examples of Phase I-type aliphatic hydrocarbon components or light solvent include at least one of $C_3$-$C_6$ paraffins and/or at least one of halogen-substituted $C_1$-$C_6$ paraffins. Examples of particular $C_3$-$C_6$ paraffins include, but are not limited to propane, butane, pentane and hexane, in which the terms "butane," "pentane" and "hexane" refer to at least one linear or branched butane, pentane or hexane, respectively. Examples of $C_1$-$C_6$ halogen-substituted paraffins include, but are not limited to chlorine and fluorine substituted paraffins, such as $C_1$-$C_6$ chlorine or fluorine substituted or $C_1$-$C_3$ chlorine or fluorine substituted paraffins. An example of an oil sands-derived oil component is an oil sands-derived, deasphalted bitumen (i.e., deasphalted bitumen that has been extracted from the oil sand) having an asphaltene content of not greater than 10 wt %, as previously described.

The term "admixture" can mean that the aliphatic compound can be mixed with the oil sands-derived, deasphalted bitumen component prior to adding to the contactor or extraction vessel. Alternatively, the term "admixture" can be understood to mean that aliphatic compound and the oil sands-derived, deasphalted bitumen component can be separately added to the contactor or extraction vessel and mixed within the vessel.

The oil sands-derived, deasphalted bitumen that is mixed with the aliphatic compound can be defined according to Hansen solubility parameters D, P and H, as indicated by the following general equation:

$$HP_{CO}=[(f_A+f_R)(HP_B-HP_{AC})+HP_{AC}]+[f_S/(f_A+f_R)]$$

wherein, $HP_{CO}$=Hansen parameter (D, P or H) of the oil sands-derived, deasphalted bitumen, $f_A$=fraction of aromatics in the oil sands-derived, deasphalted bitumen, $f_R$=fraction of resins in the oil sands-derived, deasphalted bitumen, $f_S$=fraction of saturates in the oil sands-derived, deasphalted bitumen, $HP_B$=Hansen parameter of oil sand bitumen, and $HP_{AC}$=Hansen parameter of the aliphatic compound.

The aromatics, resins and saturates fractions can be determined according to ASTM D4124-09 Standard Test Method for Separation of Asphalt into Four Fractions, also referred to as a SARA Analysis.

Hansen parameters for bitumens have been published. For example, *Hansen Solubility Parameters: A User's Handbook—2nd Ed.*, Edited by Charles Hansen, CRC Press, 2007, p. 173, indicates that Hansen parameters for Venezuelan bitumen are as follows: D=18.6; P=3.0; and H=3.4. For purposes of this invention, these Hansen parameters are taken to be representative of Hansen parameters for total bitumen on oil sand.

As an example of the general equation, the Hansen dispersion parameter of the oil sands-derived, deasphalted bitumen can be defined according to the following equation:

$$D_{CO}=[(f_A+f_R)(D_B-D_{AC})+D_{AC}]+[f_S/(f_A+f_R)]$$

The Hansen polarity parameter of the oil sands-derived, deasphalted bitumen can be defined according to the following equation:

$$P_{CO}=[(f_A+f_R)(P_B-P_{AC})+P_{AC}]+[f_S/(f_A+f_R)]$$

The Hansen hydrogen bonding parameter of the oil sands-derived, deasphalted bitumen can be defined according to the following equation:

$$H_{CO}=[(f_A+f_R)(H_B-H_{AC})+H_{AC}]+[f_S/(f_A+f_R)]$$

The aliphatic component (AC) of the solvent can be the same solvent that is used in a Phase I extraction process or it can be different. Preferably, the aliphatic component (AC) of the solvent is the same solvent that is used in a Phase I extraction process.

The Hansen dispersion parameter (D) of the Phase II solvent is desirably at least 14. The Hansen dispersion parameter can be at least 15 or at least 16. For example, Hansen dispersion parameter can range from 14 to 20. Alternatively, the Hansen dispersion parameter of the Phase II solvent can range from 14 to 19, or from 14 to 18, or from 14 to 17.

The Hansen polarity parameter (P) of the Phase II solvent is desirably at least 0.2. The Hansen polarity parameter can be at least 0.4, or 0.6, or 0.8. For example, the Hansen polarity parameter can range from 0.2 to 6. Alternatively, the Hansen polarity parameter of the Phase II solvent can range from 0.2 to 4, or from 0.2 to 3, or from 0.2 to 2.5.

The Hansen hydrogen bonding parameter (H) of the Phase II solvent is desirably at least 0.2. Alternatively, the Hansen hydrogen bonding parameter can be at least 0.4, or at least 0.6, or at least 0.8. For example, the Hansen hydrogen bonding parameter can range from 0.2 to 5. Alternatively, the Hansen hydrogen bonding parameter of the Phase II solvent can range from 0.2 to 4, or from 0.2 to 3, or from 0.2 to 2.5.

$C_3$-$C_6$ paraffins and/or halogen-substituted $C_1$-$C_6$ paraffins can be used in the Phase II extraction solvent to enhance separation and recycle efficiency, as well as to enhance stripping of residual solvent from the tailings solid material. For example, the Phase II solvent can be comprised of at least 5 wt %, or at least 10 wt %, or at least 20 wt %, or at least 30 wt %, of one or more compounds selected from the group consisting of $C_3$-$C_6$ paraffins and/or halogen-substituted $C_1$-$C_6$ paraffins, with the overall Phase II solvent composition still meeting the desired Hansen solubility parameters.

The Phase II type of hydrocarbon solvent can be comprised of from 95 wt % to 5 wt % of one or more compounds selected from the group consisting of $C_3$-$C_6$ paraffins and/or halogen-substituted $C_1$-$C_6$ paraffins and from 5 wt % to 95 wt % of the oil sands-derived, deasphalted bitumen. Alternatively, the Phase II type of hydrocarbon solvent can be comprised of from 90 wt % to 20 wt %, or from 80 wt % to 30 wt %, or from 70 wt % to 40 wt % of one or more compounds selected from the group consisting of $C_3$-$C_6$ paraffins and/or halogen-substituted $C_1$-$C_6$ paraffins and from 10 wt % to 80 wt %, or from 20 wt % to 70 wt %, or from 30 wt % to 60 wt % of the oil sands-derived, deasphalted bitumen.

Treatment of the oil sand with the Phase II solvent that contains one or more compounds selected from the group consisting of $C_3$-$C_6$ paraffins and/or halogen-substituted $C_1$-$C_6$ paraffins can be carried out under conditions in which at least a portion of the Phase II solvent contacts the oil sand in a contact zone of a contactor in the vapor phase. For example, at least 5 wt % of the Phase II solvent in the contact zone can be in the vapor phase. Alternatively, at least 10 wt %, or at least 15 wt %, or at least 20 wt % of the Phase II solvent in the contact zone can be in the vapor phase.

The Phase II extraction solvent can contain oil sands-derived, deasphalted bitumen, as well as low-asphaltene or deasphalted bitumen obtained from a refinery process such as distillation or solvent extraction of a mineral oil based crude. For example, the Phase II extraction solvent can be comprised of from 5 wt % to 80 wt %, or 5 wt % to 60 wt %, or 5 wt % to 40 wt %, or 10 wt % to 40 wt % of oil sands-derived and/or deasphalted bitumen. Of course, alternative combinations of compounds can be used in the Phase II extraction solvent, as long as the solvent meets the described Hansen solubility parameters.

Phase II solvent that contains low-asphaltene, oil sands-derived and/or deasphalted bitumen can be characterized by a low asphaltenes content. For example, the Phase II solvent can have an asphaltenes content (i.e., heptane insolubles measured according to ASTM D6560) of not greater than 10 wt %, alternatively not greater than 7 wt %, or not greater than 5 wt %, or not greater than 3 wt %, or not greater than 1 wt %, or not greater than 0.05 wt %. Lower asphaltenes content of a deasphalted bitumen-containing solvent provides an additional benefit in that there can be less plugging of filters and drain lines in the extraction vessel.

The Phase II solvent can be a blend of relatively low boiling point compounds and relatively high boiling point compounds to further enhance separation and recycle efficiency, as well as to enhance drying of the tailings solid material. Since the Phase II solvent can be a blend of low and high boiling compounds, the boiling range of solvent compounds useful according to the Phase II type process (i.e., a process that incorporates the use of a Phase II solvent) can be determined by ASTM D7169-11—Standard Test Method for Boiling Point Distribution of Samples with Residues Such as Deasphalted bitumens and Atmospheric and Vacuum Residues by High Temperature Gas Chromatography.

In one embodiment, the Phase II solvent has an ASTM D86 5% distillation point of not greater than 100° C. Alternatively, the Phase II solvent has an ASTM D86 5% distillation point of not greater than 80° C. or not greater than 50° C.

The Phase II solvent can have an ASTM D86 90% distillation point that is significantly higher than the ASTM D86 5% distillation point. For example, Phase II solvent can have an ASTM D86 90% distillation point that is at least 50° C., or at least 80° C., or at least 100° C., or at least 150° C. higher than the ASTM D86 90% distillation point of the solvent. The Phase II solvent can have an ASTM D86 90% distillation point within the range of from 50° C. to 400° C., alternatively within the range of from 60° C. to 300° C., or from 70° C. to 200° C.

A high ketone content in the Phase II solvent can be useful but is not necessary. For example, the Phase II solvent can have a ketone content of not greater than 10 wt %, alternatively not greater than 5 wt %, or not greater than 2 wt %, based on total weight of the solvent injected into the extraction vessel. The ketone content can be determined according to test method ASTM D4423-10 Standard Test Method for Determination of Carbonyls in $C_4$ Hydrocarbons.

The Phase II solvent can also contain aromatic hydrocarbons. For example, the Phase II solvent can have an aromatic content of not greater than 10 wt %, alternatively not greater than 5 wt %, or not greater than 2 wt %, based on total weight of the solvent injected into the extraction vessel. Specific examples of aromatic hydrocarbons include single ring aromatic hydrocarbons such as benzene, toluene, xylene, ethylbenzenes and methylbenzenes. The aromatic content can be determined using $^{13}C$ NMR in which the sample is dissolved in deuterated chloroform ($CDCl_3$), with the analysis being carried out at ambient temperature using a spectrophotometer such as a Bruker AVII-300 FT NMR spectrometer.

A high halohydrocarbon content in the Phase II solvent can also be useful but is not necessary. For example, the Phase II solvent can have a halohydrocarbon content of not greater than 10 wt %, alternatively not greater than 5 wt %, or not greater than 2 wt %, based on total weight of the solvent injected into the extraction vessel. The halohydrocarbon content can be determined according to test method ASTM E256-09—Standard Test Method for Chlorine in Organic Compounds by Sodium Peroxide Bomb Ignition.

A high ester content in the Phase II solvent can additionally be useful but is not necessary. For example, the Phase II solvent can have an ester content of not greater than 10 wt %, alternatively not greater than 5 wt %, or not greater than 2 wt %, based on total weight of the solvent injected into the extraction vessel. The ester content can be determined according to test method ASTM D1617-07(2012)—Standard Test Method for Ester Value of Solvents and Thinners.

The Phase II solvent preferably does not include substantial amounts of non-hydrocarbon compounds. Non-hydrocarbon compounds are considered chemical compounds that do not contain any C—H bonds. Examples of non-hydrocarbon compounds include, but are not limited to, hydrogen, nitrogen, water and the noble gases, such as helium, neon and argon. For example, the solvent preferably includes not greater than 20 wt %, alternatively not greater than 10 wt %, alternatively not greater than 5 wt %, non-hydrocarbon compounds, based on total weight of the solvent injected into the extraction vessel.

Solvent to oil sand feed ratios in a Phase II type of extraction can vary according to a variety of variables. Such variables include amount of hydrocarbon mix in the solvent, temperature and pressure of the contact zone, and contact time of hydrocarbon mix and oil sand in the contact zone. Preferably, the solvent and oil sand is supplied to the contact zone of the extraction vessel at a weight ratio of total hydrocarbon in the solvent to oil sand feed of at least 0.01:1, or at least 0.1:1, or at least 0.5:1 or at least 1:1. Very large total hydrocarbon to oil sand ratios are not required. For example, the solvent and oil sand can be supplied to the contact zone of the extraction vessel at a weight ratio of total hydrocarbon in the solvent to oil sand feed of not greater than 4:1, or 3:1, or 2:1.

Extraction of heavy bitumen composition from oil sand in the Phase II extraction can be carried out in a contact zone of a vessel. For example, a Phase II type of extraction can be carried out in a vessel of a type similar to that described according to the Phase I extraction of deasphalted bitumen from oil sand. The contacting of the oil sand with the Phase II solvent is at a temperature and pressure to provide the desired solvent vapor and liquid phases within the vessel. Each of the compositional characteristics of the Phase II type solvent described above is based on the total amount of Phase II solvent injected into a contactor vessel. This would include recycle lines in cases in which recycle lines exist.

The heavy bitumen fraction extracted from oil sand in the Phase II extraction is a heavy bitumen composition, which has an asphaltene concentration by weight, measured according to ASTM D6560, greater than that of the total oil sands bitumen, i.e., the total bitumen on the originally mined oil sands. The heavy bitumen composition can have an asphaltene concentration by weight, measured according to ASTM D6560, at least 25 wt %, or at least 50 wt %, or at least 100 wt %, or at least 200 wt %, or at least 300 wt % greater than that of the total oil sands bitumen. For example, the heavy bitumen composition can have an asphaltene content of greater than 10 wt %, or greater than 20 wt %, or greater than 30 wt %, or greater than 40 wt % measured according to ASTM D6560.

The heavy bitumen composition recovered from the Phase II type extraction can be used as desired. For example, the heavy bitumen composition can be sent to a refinery for upgrading to a higher quality petroleum product such as a synthetic crude or for further upgrading into a transportation fuel such as a component of diesel, jet fuel or gasoline. Alternatively, at least a portion of the heavy bitumen composition can be used as an asphalt binder for concrete or roofing materials.

Utilization of the Heavy Bitumen Compositions

Since the heavy bitumen composition initially recovered from the Phase II type of extraction can include a substantial amount of the Phase II solvent, this heavy bitumen composition can be referred to as solvent-diluted bitumen. The solvent-diluted, heavy bitumen can be sufficiently high in API gravity such that the solvent-diluted bitumen can be transported relatively easily. For example, the solvent-diluted bitumen can be transported to a refinery for upgrading into a higher quality crude and/or into various transportation fuels.

A portion of the Phase II solvent can also be separated from the solvent-diluted bitumen and utilized in various refinery or chemical processes. For example, a substantial portion of the light ends of the solvent-diluted bitumen can be separated from the solvent-diluted bitumen can be separated for use as a feedstream in a variety of chemical processing units or as a solvent for a variety of chemical or refinery streams. Alternatively, the light ends of the solvent-diluted bitumen can be separated from the solvent-diluted bitumen and recycled to the Phase II treatment type of process for addition the Phase II solvent. Separation can be by any suitable means. Non-limiting examples of separation processes include, but are not limited to, flash distillation and column distillation.

In one embodiment, a light fraction having a final boiling point, as measured according to ASTM D86, of not greater than 100° C. can be separated from the solvent-diluted bitumen and recycled to the Phase II type process to produce a light Phase II recycle fraction and a heavy bitumen fraction. Alternatively, a light fraction having a final boiling point, as measured according to ASTM D86, of not greater than 80° C., or not greater than 50° C., or not greater than 30° C., or not greater than 10° C., can be separated from the solvent-diluted bitumen and recycled to the Phase II type process to produce a light Phase II recycle fraction and a heavy bitumen fraction.

In another embodiment, at least a portion of the paraffin and/or halogen substituted paraffin can be separated from the solvent-diluted bitumen to produce a light Phase II recycle fraction and a heavy bitumen fraction. Examples of the paraffin and/or halogen substituted paraffin that can be separated and recycled as a light Phase II recycle stream are as previously described with regard to the Phase II extraction solvent.

The solvent-diluted bitumen recovered from the Phase II type of extraction and/or the heavy bitumen fraction produced from separation of the light ends of the solvent-diluted bitumen can be used as a feedstock stream for upgrading into a higher quality crude and/or into various transportation fuels. The upgraded product can also be transported to other locations for additional upgrading to multiple products.

Upgrading of the solvent-diluted bitumen recovered from the Phase II type of extraction and/or the heavy bitumen fraction produced from separation of the light ends of the solvent-diluted bitumen can be accomplished by hydroprocessing. Hydroprocessing generally refers to treating or upgrading the heavy bitumen composition that contacts the hydroprocessing catalyst. Hydroprocessing particularly refers to any process that is carried out in the presence of hydrogen, including, but not limited to, hydroconversion, hydrocracking (which includes selective hydrocracking), hydrogenation, hydrotreating, hydrodesulfurization, hydrodenitrogenation, hydrodemetallation, hydrodearomatization, hydroisomerization, and hydrodewaxing including selective hydrocracking.

The hydroprocessing reaction is carried out in a vessel or a hydroprocessing zone in which heavy hydrocarbon and solvent contact the hydroprocessing catalyst in the presence of hydrogen. The term "hydroprocessing reactor" shall refer to any vessel in which hydrotreating (e.g., reducing oxygen, sulfur, nitrogen and/or metals content, alternatively saturation of unsaturated hydrocarbons) or hydrocracking (e.g., cleaving carbon-carbon bonds and/or reducing the boiling range) of a feedstock in the presence of hydrogen and a hydroprocessing catalyst is the primary purpose. Hydroprocessing reactors are characterized as having an input port into which the deasphalted bitumen or heavy bitumen feedstocks and hydrogen can be introduced, an output port from which an upgraded feedstock or material can be withdrawn, and sufficient thermal energy to carry out the hydrotreating and/or hydrocracking reactions. Examples of hydroprocessing reactors particularly suitable for hydroprocessing the heavy bitumen compositions include, but are not limited to, slurry phase reactors (a two phase, gas-liquid system), ebullated bed reactors (a three phase, gas-liquid-solid system), fixed bed reactors (a three-phase system that includes a liquid feed trickling downward over a fixed bed of solid supported catalyst with hydrogen typically flowing cocurrently, but possibly countercurrently in some cases).

Contacting conditions in the contacting or hydroprocessing zone can include, but are not limited to, temperature, pressure, hydrogen flow, hydrocarbon feed flow, or combinations thereof. Contacting conditions in some embodiments are controlled to yield a product with specific properties.

Hydroprocessing is carried out in the presence of hydrogen. A hydrogen stream is, therefore, fed or injected into a vessel or reaction zone or hydroprocessing zone in which the hydroprocessing catalyst is located. Hydrogen, which is contained in a hydrogen "treat gas," is provided to the reaction zone. Treat gas, as referred to herein, can be either pure hydrogen or a hydrogen-containing gas, which is a gas stream containing hydrogen in an amount that is sufficient for the intended reaction(s), optionally including one or more other gasses (e.g., nitrogen and light hydrocarbons such as methane), and which will not adversely interfere with or affect either the reactions or the products. Impurities, such as $H_2S$ and $NH_3$ are undesirable and would typically be removed from the treat gas before it is conducted to the reactor. The treat gas stream introduced into a reaction stage will preferably contain at least about 50 vol. % and more preferably at least about 75 vol. % hydrogen.

Hydrogen can be supplied at a rate of from 500 SCF/B (standard cubic feet of hydrogen per barrel of total feed) (89 S $m^3/m^3$), or from 1000 SCF/B (178 S $m^3/m^3$), to 10000 SCF/B (1780 S $m^3/m^3$). Preferably, the hydrogen is provided in a range of from 500 SCF/B (89 S $m^3/m^3$) to 5000 SCF/B (891 S $m^3/m^3$).

Hydrogen can be supplied co-currently with the heavy hydrocarbon oil and/or solvent or separately via a separate gas conduit to the hydroprocessing zone. The contact of the heavy hydrocarbon oil and solvent with the hydroprocessing catalyst and the hydrogen produces a total product that includes a hydroprocessed oil product, and, in some embodiments, gas.

The temperature in the contacting zone can be at least about 550° F. (278° C.), such as at least about 600° F. (316° C.); and about 750° F. (399° C.) or less or about 700° F. (371° C.) or less. Alternatively, temperature in the contacting zone can be at least about 700° F. (371° C.), or at least about 750° F. (399° C.); and about 950° F. (510° C.) or less, or about 850° F. (454° C.) or less.

Total pressure in the contacting zone can range from 200 psig (1379 kPa-g) to 3000 psig (20684 kPa-g), such as from 400 psig (2758 kPa-g) to 2000 psig (13790 kPa-g), or from 650 psig (4482 kPa-g) to 1500 psig (10342 kPa-g), or from 650 psig (4482 kPa-g) to 1200 psig (8273 kPa-g). The heavy bitumen composition can also be hydroprocessed under low hydrogen partial pressure conditions. In such aspects, the hydrogen partial pressure during hydroprocessing can be from about 200 psia (1379 kPa) to about 1000 psia (6895 kPa), such as from 500 psia (3447 kPa) to about 800 psia (5516 kPa). Additionally or alternately, the hydrogen partial pressure can be at least about 200 psia (1379 kPa), or at least about 400 psia (2758 kPa), or at least about 600 psia (4137 kPa). Additionally or alternately, the hydrogen partial pressure can be about 1000 psia (6895 kPa) or less, such as about 900 psia (6205 kPa) or less, or about 850 psia (5861 kPa) or less, or about 800 psia (5516 kPa) or less, or about 750 psia (5171 kPa) or less. In such aspects with low hydrogen partial pressure, the total pressure in the reactor can be about 1200 psig (8274 kPa-g) or less, and preferably 1000 psig (6895 kPa-g) or less, such as about 900 psig (6205 kPa-g) or less or about 800 psig (5516 kPa-g) or less.

Liquid hourly space velocity (LHSV) of the combined heavy hydrocarbon oil and recycle components will generally range from 0.1 to 30 $h^{-1}$, or 0.4 $h^{-1}$ to 20 $h^{-1}$, or 0.5 to 10 $h^{-1}$. In some aspects, LHSV is at least 15 $h^{-1}$, or at least 10 $h^{-1}$, or at least 5 $h^{-}$. Alternatively, in some aspects LHSV is about 2.0 $h^{-1}$ or less, or about 1.5 $h^{-1}$ or less, or about 1.0 $h^{-1}$ or less.

Based on the reaction conditions described above, in various aspects of the invention, a portion of the reactions taking place in the hydroprocessing reaction environment can correspond to thermal cracking reactions. In addition to the reactions expected during hydroprocessing of a bitumen feed in the presence of hydrogen and a hydroprocessing catalyst, thermal cracking reactions can also occur at temperatures of 360° C. and greater. In the hydroprocessing reaction environment, the presence of hydrogen and catalyst can reduce the likelihood of coke formation based on radicals formed during thermal cracking.

In an embodiment of the invention, contacting the input bitumen feed to the hydroconversion reactor with a hydroprocessing catalyst in the presence of hydrogen to produce a hydroprocessed product can be carried out in a single contacting zone. In another aspect, contacting can be carried out in two or more contacting zones.

The hydroprocessing catalyst can comprise at least one Group 6 metal (IUPAC periodic table), at least one Group 8-10 metal (IUPAC periodic table), optionally a carrier. Examples of the Group 6 metal include at least one metal selected from the group consisting of Cr, Mo and W. Examples of preferred Group 6 metals are Mo and W. Examples of Group 8-10 metals include Fe, Ru, Os, Co, Rh, Ir, Ni, Pd and Pt. Examples of preferred Group 8-10 metals include Fe, Co, Ni, Pd and Pt. Examples of preferred combinations of metals include at least two of Mo, W, Fe, Co, Ni, Pd and Pt. Other examples of preferred combinations of metals include at least two of Mo, W, Co and Ni. Other combinations can also be effective, such as NiMo and NiMoW combination described in US Patent Pub. No. 2013/0161237. The various combinations of metals can be supported on the same carrier support or on multiple supports in admixture. The hydroprocessing catalysts optionally include transition metal sulfides that are impregnated or dispersed on a refractory support or carrier such as alumina and/or silica. The support or carrier itself typically has no significant/measurable catalytic activity, such as for hydrogenation. However, the support or carrier can bring about acid catalyst skeletal rearrangements of the hydrocarbon, depending upon the Si/Al ratio and the resulting acidity. Substantially carrier- or support-free catalysts, commonly referred to as bulk catalysts, generally have higher volumetric activities than their supported counterparts.

The catalysts can either be in bulk form or in supported form. In addition to alumina and/or silica, other suitable support/carrier materials can include, but are not limited to, zeolites, titania, silica-titania, and titania-alumina. It is within the scope of the invention that more than one type of hydroprocessing catalyst can be used in one or multiple reaction vessels.

The Group 8-10 metals can be present in the hydroprocessing catalyst in oxide form. For example, the hydroprocessing catalyst can be comprised of a total of from about 2 wt % to about 30 wt % Group 8-10 metals in oxide form, based on total weight of the catalyst. Alternatively, the hydroprocessing catalyst can be comprised of a total of from about 4 wt % to about 15 wt % Group 8-10 metals in oxide form, based on total weight of the catalyst.

The Group 6 metals can also be present in oxide form. For example, the hydroprocessing catalyst can be comprised of a total of from about 2 wt % to about 60 wt % Group 6 metals in oxide form, based on total weight of the catalyst. Alternatively, the hydroprocessing catalyst can be comprised of a total of from about 6 wt % to about 40 wt %, or from about 10 wt % to about 30 wt %, Group 6 metals in oxide form, based on total weight of the catalyst. It is noted that under hydroprocessing conditions, the metals may be present as metal sulfides and/or may be converted metal sulfides prior to performing hydroprocessing on an intended feed.

A vessel or hydroprocessing zone in which catalytic activity occurs can include one or more hydroprocessing catalysts. Such catalysts can be mixed or stacked, with the catalyst preferably being in a fixed bed in the vessel or hydroprocessing zone.

The support can be impregnated with the desired metals to form the hydroprocessing catalyst. In particular impregnation embodiments, the support is heat treated at temperatures in a range of from 400° C. to 1200° C. (752° F. to 2192° F.), or from 450° C. to 1000° C. (842° F. to 1832° F.), or from 600° C. to 900° C. (1112° F. to 1652° F.), prior to impregnation with the metals.

In an alternative embodiment, the hydroprocessing catalyst is comprised of shaped extrudates. The extrudate diameters range from 1/32 to 1/8 inch, from 1/20 to 1/10 inch, or from 1/2 to 1/16 inch. The extrudates can be cylindrical or shaped. Non-limiting examples of extrudate shapes include trilobes and quadralobes.

The process of this invention can be effectively carried out using a hydroprocessing catalyst having any median pore diameter effective for hydroprocessing the heavy oil component. For example, the median pore diameter can be in the range of from 30 to 1000 Å (Angstroms), or 50 to 500 Å, or 60 to 300 Å. Pore diameter is preferably determined according to ASTM Method D4284-07 Mercury Porosimetry.

In a particular embodiment, the hydroprocessing catalyst can have a median pore diameter in a range of from 50 to 200 Å. Alternatively, the hydroprocessing catalyst can have a median pore diameter in a range of from 90 to 180 Å, or 100 to 140 Å, or 110 to 130 Å.

The hydroprocessing catalyst can also be a large pore diameter catalyst. For example, the process can be effective using a hydroprocessing catalyst having a median pore diameter in a range of from 180 to 500 Å, or 200 to 300 Å, or 230 to 250 Å.

It is preferred that the hydroprocessing catalyst have a pore size distribution that is not so great as to negatively impact catalyst activity or selectivity. For example, the hydroprocessing catalyst can have a pore size distribution in which at least 60% of the pores have a pore diameter within 45 Å, 35 Å, or 25 Å of the median pore diameter. In certain embodiments, the catalyst can have a median pore diameter in a range of from 50 to 180 Å, or from 60 to 150 Å, with at least 60% of the pores having a pore diameter within 45 Å, 35 Å, or 25 Å of the median pore diameter.

In some alternative embodiments, the process of this invention can be effectively carried out using a hydroprocessing catalyst having a median pore diameter of at least 85 Å, such as at least 90 Å, and a median pore diameter of 120 Å or less, such as 105 Å or less. This can correspond, for example, to a catalyst with a median pore diameter from 85 Å to 120 Å, such as from 85 Å to 100 Å or from 85 Å to 98 Å. In certain alternative embodiments, the catalyst can have a median pore diameter in a range of from 85 Å to 120 Å, with at least 60% of the pores having a pore diameter within 45 Å, 35 Å, or 25 Å of the median pore diameter.

Pore volume should be sufficiently large to further contribute to catalyst activity or selectivity. For example, the hydroprocessing catalyst can have a pore volume of at least 0.3 $cm^3/g$, at least 0.7 $cm^3/g$, or at least 0.9 $cm^3/g$. In certain embodiments, pore volume can range from 0.3-0.99 $cm^3/g$, 0.4-0.8 $cm^3/g$, or 0.5-0.7 $cm^3/g$.

In certain embodiments, the catalyst can be in shaped forms. For example, the catalyst can be in the form of pellets, cylinders, and/or extrudates. The catalyst typically has a flat plate crush strength in a range of from 50-500 N/cm, or 60-400 N/cm, or 100-350 N/cm, or 200-300 N/cm, or 220-280 N/cm.

In some aspects, a combination of catalysts can be used for hydroprocessing of a bitumen feed composition. For example, a bitumen feed can be contacted first by a demetallation catalyst, such as a catalyst including NiMo or CoMo on a support with a median pore diameter of 200 Å or greater. A demetallation catalyst represents a lower activity catalyst that is effective for removing at least a portion of the metals content of a feed. This can result in the removal of a portion of the metals from the feedstock, and extend the lifetime of any subsequent catalyst. For example, the demetallized effluent from the demetallation process can be contacted with a catalyst having a different median pore diameter, such as a median pore diameter of 85 Å to 120 Å.

Relative to the heavy bitumen compositions extracted in the Phase II type of extraction process and used as feedstock for hydroprocessing, the hydroprocessed product will be a material or crude product that exhibits reductions in such properties as average molecular weight, boiling point range, density and/or concentration of sulfur, nitrogen, oxygen, and metals.

In an embodiment of the invention, contacting the bitumen feed composition and recycle or other solvent component with the hydroprocessing catalyst in the presence of hydrogen to produce a hydroprocessed product can be carried out in a single contacting zone. In another embodiment, contacting can be carried out in two or more contacting zones. The total hydroprocessed product can be separated to form one or more particularly desired liquid products and one or more gas products.

In some embodiments of the invention, the liquid hydroprocessed product can be blended with a hydrocarbon feedstock that is the same as or different from the bitumen feed composition. For example, the liquid hydroprocessed product can be combined with a heavy bitumen composition having a different viscosity, including the bitumen feed composition obtained from a Phase II type extraction process, resulting in a blended product having a viscosity that is between the viscosity of the liquid hydroprocessed product and the viscosity of the bitumen feed composition. As another example, a fraction of the liquid hydroprocessed product can be recycled to the hydroprocessing process by combining with the bitumen feed composition to provide a combined feedstock. The combined feedstock can then be hydroprocessed. As one example, a light or overhead fraction of the hydroprocessed product can be separated and used as a recycle stream, which is combined with a bitumen feedstock component for additional hydroprocessing. In particular, a light hydroprocessed fraction having an ASTM D86 final boiling point of not greater than about 650° F. (343° C.) or not greater than about 600° F. (316° C.), or not greater than about 500° F. (26° C.), or not greater than about 400° F. (204° C.), can be recycled and combined with a bitumen feedstock composition, such as a bitumen feedstock composition extracted according to the Phase II type of extraction previously described. The light hydroprocessed fraction that can be recycled and combined with the bitumen feedstock composition can also have an ASTM D86 initial boiling point of not less than 10° C., or not less than 30° C., or not less than 50° C., or not less than 80° C. The light hydroprocessed fraction and the heavy bitumen composition can be combined at a weight ratio of light hydroprocessed fraction to bitumen of from 0.05:1 to 2:1, such as from 0.1:1 to 1.5:1, or from 0.1:1 to 1:1.

In some embodiments of the invention, the hydroprocessed product and/or the blended product are transported to a refinery and distilled to produce one or more distillate fractions. The distillate fractions can be catalytically processed to produce commercial products such as transportation fuel, lubricants, or chemicals. A bottoms fraction can also be produced, such as bottoms fraction with an ASTM D86 10% distillation point of at least about 600° F. (316° C.), or an ASTM D86 10% distillation point of at least about 650° F. (343° C.), or a bottoms fraction with a still higher 10% distillation point, such as at least about 750° F. (399° C.) or at least about 800° F. (427° C.).

In some embodiments of the invention, the hydroprocessed product has a total Ni/V/Fe content of at most 50%, or at most 30%, or at most 10%, or at most 5%, or at most 1% of the total Ni/V/Fe content (by wt %) of the bitumen feed component. In certain embodiments, the fraction of the hydroprocessed product that has an ASTM D86 10% distillation point of at least about 650° F. (343° C.) and higher (i.e., 650° F.+ product fraction) has, per gram of 650° F.+(343° C.+) product fraction, a total Ni/V/Fe content in a range of from $1\times10^{-7}$ grams to $2\times10^{-4}$ grams (0.1 to 200 ppm), or $3\times10^{-7}$ grams to $1\times10^{4}$ grams (0.3 to 100 ppm), or $1\times10^{-6}$ grams to $1\times10^{-4}$ grams (1 to 100 ppm). In certain embodiments, the 650° F.+(343° C.+) product fraction has not greater than $4\times10^{-5}$ grams of Ni/V/Fe (40 ppm).

In certain embodiments of the invention, the hydroprocessed product has an API gravity that is greater than 100%, or greater than 200%, or greater than 300% of that of the heavy bitumen feed component. In certain embodiments, API gravity of the hydroprocessed product is from 10°-40°, or 12°-35°, or 14°-30°.

In an alternative embodiment, the 650° F.+(343° C.+) product fraction can have a viscosity at 100° C. of 10 to 150 cSt, or 15 to 120 cSt, or 20 to 100 cSt. In certain embodiments, the 650° F.+(343° C.+) product fraction has a viscosity of at most 90%, or at most 50%, or at most 5% of that of the heavy bitumen feed component.

In some embodiments of the invention, the hydroprocessed product has a total heteroatom (i.e., S/N/O) content of at most 50%, or at most 25%, or at most 10%, or at most 5% of the total heteroatom content of the bitumen feed component.

In some embodiments of the invention, the sulfur content of the hydroprocessed product is at most 50%, or at most 10%, or at most 5% of the sulfur content (by wt %) of the bitumen feed component. The total nitrogen content of the hydroprocessed product is at most 85%, or at most 50%, or at most 25% of the total nitrogen (by wt %) of the bitumen feed component.

EXAMPLES

Example I

Determination of Hansen Parameters of Deasphalted bitumen

Oil sands ore from Canada's Athabasca region is crushed and fed to an extraction chamber. The crushed ore is moved through the extraction chamber, while being contacted with propane solvent, representing a Phase I type solvent. The extraction chamber consists of an auger type moving device in which the auger is used to move the particles through the chamber, and the Phase I solvent is injected into the extraction chamber as the particles move through the extraction chamber. An example of the device is depicted in U.S. Pat. No. 7,384,557.

The extraction is carried out at a temperature of 80° F. (27° C.) and a pressure of 148 psia (10.1 atm). Approximately 60 wt % of the bitumen is determined to be extracted from the oil sand, with the remainder of the bitumen staying attached to the oil sand. Following extraction of the bitumen fraction from the ore, a mixture of the extracted bitumen and solvent is collected. The solvent is separated from the extracted bitumen by flash evaporation.

The extracted bitumen fraction is analyzed for saturates, aromatics, resins and asphaltenes, according to ASTM D2124. The results are shown in the following Table 13.

TABLE 13

| SARA Characteristics ASTM D4124 | Wt. % |
|---|---|
| Saturates | 37 |
| Aromatics | 25 |
| Resins | 37.5 |
| Asphaltenes | 0.5 |

As shown in Table 1, the bitumen fraction extracted from the oil sand using propane has only about 0.5 wt % asphaltenes, which is considered a deasphalted bitumen composition.

Hansen parameters D, P and H are determined for the oil sands-derived, deasphalted bitumen based on the equation:

$$HP_{CO}=[(f_A+f_R)(HP_B-HP_{AC})+HP_{AC}]+[f_S/(f_A+f_R)]$$

wherein, $HP_{CO}$=Hansen parameter (D, P or H) of the oil sands-derived, deasphalted bitumen, $f_A$=fraction of aromatics in the oil sands-derived, deasphalted bitumen (0.25), $f_R$=fraction of resins in the oil sands-derived, deasphalted bitumen (0.375), $f_S$=fraction of saturates in the oil sands-derived, deasphalted bitumen (0.37), $HP_B$=Hansen parameter of oil sand bitumen (D=18.6; P=3.0; and H=3.4), and $HP_{AC}$=Hansen parameter of propane (D=13.9; P=0; and H=0).

The Hansen parameters for the oil sands-derived, deasphalted bitumen are determined to be D=17.4; P=2.5; and H=2.7.

Example II

Determination of Hansen Parameters of Phase II Solvent

Phase II type solvents for extracting the remainder of the bitumen on the extracted oil sand in Example I are prepared by mixing together varying amounts of propane and the oil sands-derived, deasphalted bitumen described in Example I and varying amounts of pentane and the oil sands-derived, deasphalted bitumen described in Example I. The prepared solvents are as shown in Tables 14 and 15, respectively, which also show the Hansen parameters for the solvents. The Hansen parameters are calculated according to the mathematical mixing rule as previously described, based on the Hansen parameters previously described for propane, pentane, and the estimated values for the oil sands-derived, deasphalted bitumen calculated in Example I.

TABLE 14

| Phase II Solvent | Hansen Parameter | | |
|---|---|---|---|
| Crude/Propane, wt % | D | P | H |
| 80/20 | 16.7 | 2.0 | 2.2 |
| 50/50 | 15.7 | 1.3 | 1.4 |
| 20/80 | 14.6 | 0.5 | 0.5 |

TABLE 15

| Phase II Solvent | Hansen Parameter | | |
|---|---|---|---|
| Crude/Pentane, wt % | D | P | H |
| 80/20 | 16.8 | 2.0 | 2.2 |
| 50/50 | 16.0 | 1.3 | 1.4 |
| 20/80 | 15.1 | 0.5 | 0.5 |

It is expected that the solvents having Hansen parameters closer to petroleum bitumen will remove greater amounts of bitumen from the oil sand. Therefore, it is expected that the solvents shown in Table 14 will be increasingly effective in removing the remainder of the bitumen from the oil sand treated in Example 1 as follows: 80/20>50/50>20/80. It is also expected that the solvents shown in Table 15 will be increasingly effective over the solvents shown in Table 14.

Example III

Hydroprocessing Deasphalted Bitumen Produced from a Phase I Separation

A sample of the deasphalted bitumen obtained in Example I is assessed for hydroprocessing in the presence of hydrogen using a hydroprocessing catalyst comprised of CoMo. The sample is first analyzed to determine levels of carbon, hydrogen, sulfur, nitrogen and aromatic carbon. The levels the components are shown in the following Table 16.

TABLE 16

| Deasphalted Bitumen Characteristics | Wt. % |
|---|---|
| Carbon, ASTM D5291 | 84.0 |
| Hydrogen, ASTM D5291 | 11.6 |
| Sulfur, ASTM D4294 | 3.2 |
| Nitrogen, ASTM D5792 | 0.2 |
| Aromatic Carbon, $^{13}C$ NMR | 25 |

Based on the analyses of Table 16; overall bitumen compositions described in "The Chemistry of the Alberta Oil Sand Bitmen," O. P. Strausz, https://web.anl.gov/PCS/acsfuel/preprint%20archive/Files/22_3_MONTREAL_06-77_0171.pdf; and molecular weights described in Fuel Science and Technology Handbook, J. G. Speight ed., Chap. 14, 1990, light components of the deasphalted bitumen oil can be expressed as an equal mixture of compounds represented according to the following general chemical formulae:

$$C_{29}H_{48}S \quad \text{(Formula 1)}$$

$$C_{29}H_{48}O_2 \quad \text{(Formula 2)}$$

Based on Formulae 1 and 2, the deasphalted bitumen composition can be hydroprocessed in the presence of hydrogen using a hydroprocessing catalyst comprised of CoMo according to the following reactions.

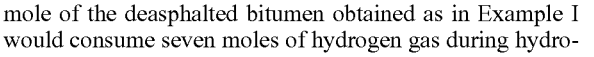

$$C_{29}H_{48}S+7H_2 \rightarrow C_9H_{12}^{*}+2C_7H_{16}+C_5H_{12}+CH_4+H_2S \quad \text{(Reaction 1)}$$

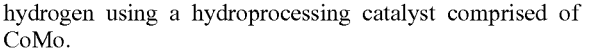

$$C_{29}H_{48}O_2+7H_2 \rightarrow C_{10}H_{14}^{*}+2C_6H_{14}+C_7H_{16}+2H_2O \quad \text{(Reaction 2)}$$

wherein * represents an aromatic compound.

Reactions 1 and 2 show that it can be expected that one mole of the deasphalted bitumen obtained as in Example I would consume seven moles of hydrogen gas during hydroprocessing of the deasphalted bitumen in the presence of hydrogen using a hydroprocessing catalyst comprised of CoMo.

Example IV

Hydroprocessing Heavy Bitumen Produced from a Phase II Separation

The treated oil sand of Example I (i.e., the oil sand having been subjected to the extraction process of Example I containing approximately 40 wt % of the bitumen from the original oil sands ore) is contacted with a Phase II solvent as described in Example II (e.g., Phase II Solvent of 80 wt % crude and 20 wt % propane (D=16.7; P=2.0; H=2.2)). At least 90 wt % of the remaining bitumen is extracted from the oil sands following treatment with the Phase II Solvent. A light fraction is then separated from the extracted bitumen by flash evaporation, producing a heavy bitumen composition.

On the basis of the characteristics of the deasphalted bitumen described in Example III, the heavy bitumen composition extracted using the Phase II solvent can be expressed as a mixture of hydrocarbons represented according to the following general chemical formula:

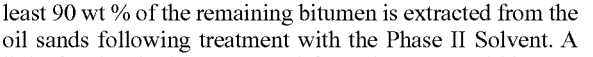

$$C_{29}H_{34}OS \quad \text{(Formula 3)}$$

Based on the Formula 3, the heavy bitumen composition can be hydroprocessed in the presence of hydrogen using a hydroprocessing catalyst comprised of CoMo according to the following reaction.

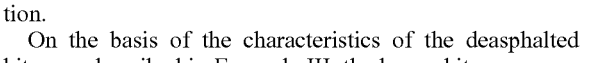

$$C_{29}H_{34}OS+11H_2 \rightarrow C_9H_{12}^{*}+C_7H_8^{*}+2C_6H_{14}+CH_4+H_2O+H_2S \quad \text{(Reaction 3)},$$

wherein * represents an aromatic compound.

Reaction 3 shows that it can be expected that one mole of the heavy bitumen composition extracted using the Phase II solvent can be hydroprocessed in the presence of hydrogen using a hydroprocessing catalyst comprised of CoMo, consuming 11 moles of hydrogen gas per mole of the heavy bitumen composition during hydroprocessing.

Example V

Hydroprocessing Total Bitumen Produced from Naphtha Separation

Oil sands ore from Canada's Athabasca region is crushed and fed to an extraction chamber. The crushed ore is moved through the extraction chamber, while being contacted with naphtha as the solvent. At least 90 wt % of the bitumen is extracted from the oil sands. A light fraction, e.g., the naphtha fraction, is separated from the extracted bitumen producing a total bitumen composition.

On the basis of the information of the Strausz and Speight references referred to in Example III, characteristics of the total bitumen composition extracted from oil sands ore using only naphtha solvent can be expressed as a mixture of hydrocarbons represented according to the following general chemical formula:

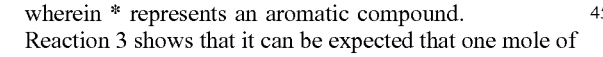

$$C_{29}H_{42}OS \quad \text{(Formula 4)}$$

Based on Formula 4, the total bitumen composition extracted from an oil sands ore using only naphtha solvent can be hydroprocessed in the presence of hydrogen using a hydroprocessing catalyst comprised of CoMo according to the following reaction.

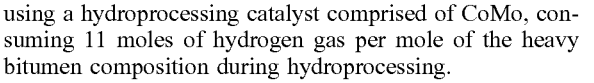

$$C_{29}H_{42}OS+11H_2 \rightarrow +C_9H_{12}^{*}+C_7C_{16}+2C_6H_{14}+CH_4+H_2O+H_2S \quad \text{(Reaction 4)},$$

wherein * represents an aromatic compound.

Reaction 4 shows that it can be expected that one mole of the total bitumen composition extracted from an oil sands ore using only naphtha solvent would consume 11 moles of hydrogen gas during hydroprocessing of the total bitumen composition in the presence of hydrogen using a hydroprocessing catalyst comprised of CoMo.

Example VI

Comparison of Hydrogen Consumption for Hydroprocessing Bitumen Compositions From a Phase I and II Process and Total Bitumen from a Single-Phase Process Example I shows that 60% of the total bitumen present on an oil sands ore can be extracted using a Phase I type solvent to produce a deasphalted bitumen composition.

Example II shows that a Phase II type solvent can be prepared to extract the remaining 40% of the total bitumen present on an oil sands ore that has been previously treated with a Phase I type solvent. The composition extracted using the Phase II type solvent is referred to as the heavy bitumen composition (Example IV).

Examples III-IV respectively show that the deasphalted bitumen composition obtained using a Phase I type solvent and the heavy bitumen composition obtained using a Phase II type solvent can be hydroprocessed in the presence of hydrogen using a hydroprocessing catalyst comprised of CoMo. Examples III-IV further show that, on a 100 mole basis of total bitumen present on oil sands ore, the Phase I solvent can be used to extract approximately 60 moles of the total bitumen as a deasphalted bitumen composition. The Phase II solvent can be used to extract essentially all of the remaining total bitumen as a heavy bitumen composition (approximated as extracting 40 moles of the total bitumen as a heavy bitumen composition). Reactions 1-2 of Example III show that hydroprocessing 60 moles of the deasphalted bitumen composition would consume 420 moles of hydrogen (7 moles $H_2$ consumed per mole of deasphalted bitumen composition). Reaction 3 of Example IV shows that hydroprocessing the remaining 40 moles of the remaining heavy bitumen composition extracted using the Phase II solvent would consume 440 moles of hydrogen (11 moles $H_2$ consumed per mole of heavy bitumen composition). Thus, on a 100 mole basis, extracting the total bitumen from an oil sands ore using a Phase I and Phase II process would produce bitumen compositions, which can be upgraded by hydroprocessing, consuming a total of 860 moles of hydrogen.

Example V shows that a naphtha solvent can be used to extract essentially all of the total bitumen from oil sands ore in a one-phase or single-phase extraction. Reaction 4 of Example V shows that, on a 100 mole basis, the total bitumen extracted using the naphtha solvent would consume 1100 moles of hydrogen (11 moles $H_2$ consumed per mole of total bitumen composition).

Examples I-V collectively show that hydroprocessing bitumen extracted from an oil sands using separate Phase I and Phase II type extractions can be hydroprocessed using only 78 mole % of the $H_2$ needed to hydroprocess the bitumen extracted from single step extraction using a naphtha type solvent ((860/1100)×100). Thus, the use of a Phase I and II type solvent system would provide bitumen compositions that can be upgraded to transportation grade liquid fuels at a substantial reduction in hydrogen consumption relative to bitumen compositions currently being produced.

The principles and modes of operation of this invention have been described above with reference to various exemplary and preferred embodiments. As understood by those of skill in the art, this invention also encompasses a variety of preferred embodiments within the overall description of the invention as defined by the claims, which embodiments have not necessarily been specifically enumerated herein.

The invention claimed is:

1. A process for upgrading a heavy bitumen feedstock to at least one of synthetic crude or transportation fuel, comprising:

a) obtaining the heavy bitumen feedstock for upgrading, wherein the heavy bitumen feedstock is a heavy bitumen composition recovered from a waterless extraction process that includes the steps of:

(i) extracting a bitumen composition from an oil sand composition by treating the oil sand composition in a contact zone of an contactor with a solvent comprised of an admixture of 1) from 70 wt % to 40 wt % of at least one of propane and butane and 2) from 30 wt % to 60 wt % of a deasphalted bitumen having an asphaltene content of not greater than 10 wt %, measured as heptane insolubles according to ASTM D6560, and (ii) recovering at least a portion of the bitumen composition extracted in step (i) as the heavy bitumen feedstock for upgrading; and b) upgrading the heavy bitumen feedstock obtained in step a) by contacting the obtained bitumen feedstock with a hydroprocessing catalyst in the presence of hydrogen to produce the synthetic crude, transportation fuel or both, wherein the hydroprocessing catalyst comprises at least one Group 6 metal and at least one Group 8-10 metal.

2. The process of claim 1, wherein upgrading includes at least one of hydroconversion, hydrocracking, hydrogenation, hydrotreating, hydrodesulfurizati on, hydrodenitrogenation, hydrodemetallation, hydrodearomatization, hydroisomerization, and hydrodewaxing.

3. The process of claim 2, wherein upgrading is carried out in a contact zone of at least one hydroprocessing reactor selected from the group consisting of slurry phase reactors, ebullated bed reactors, cocurrent fixed bed reactors and countercurrent fixed bed reactors.

4. The process of claim 1, wherein the hydrocarbon solvent has a Hansen dispersion blend parameter of at least 14 $MPa^{1/2}$.

5. The process of claim 4, wherein at least 70 wt % of the solvent in the contact zone of the contactor is in liquid phase.

6. The process of claim 1, wherein at least 5 wt % of the solvent in the contact zone of the contactor is in vapor phase.

7. A process for upgrading a heavy bitumen feedstock to at least one of synthetic crude or transportation fuel, comprising:

a) extracting a bitumen composition from an oil sand composition through waterless extraction, wherein the waterless extraction is carried out by treating the oil sand composition in a contact zone of an contactor with a solvent comprised of an admixture of 1) from 70 wt % to 40 wt % of at least one of propane and butane and 2) from 30 wt % to 60 wt % of a deasphalted bitumen having an asphaltene content of not greater than 10 wt %, measured as heptane insolubles according to ASTM D6560 b) recovering at least a portion of the bitumen composition extracted in step a) as the heavy bitumen feedstock for upgrading; and c) upgrading the recovered heavy bitumen feedstock by contacting the recovered heavy bitumen feedstock with a hydroprocessing catalyst in the presence of hydrogen to produce the synthetic crude, transportation fuel or both, wherein the hydroprocessing catalyst comprises at least one Group 6 metal and at least one Group 8-10 metal.

8. The process of claim 7, wherein upgrading includes at least one of hydroconversion, hydrocracking, hydrogenation, hydrotreating, hydrodesulfurization, hydrodenitrogenation, hydrodemetallation, hydrodearomatization, hydroisomerization, and hydrodewaxing.

9. The process of claim 8, wherein upgrading is carried out in a contact zone of at least one hydroprocessing reactor selected from the group consisting of slurry phase reactors, ebullated bed reactors, cocurrent fixed bed reactors and countercurrent fixed bed reactors.

10. The process of claim 7, wherein the hydrocarbon solvent has a Hansen dispersion blend parameter of at least 14 $MPa^{1/2}$.

11. The process of claim 7, wherein at least 5 wt % of the solvent in the contact zone of the contactor is in vapor phase.

12. The process of claim 11, wherein at least 70 wt % of the solvent in the contact zone of the contactor is in liquid phase.

* * * * *